US008178268B2

(12) United States Patent
Watanabe et al.

(10) Patent No.: US 8,178,268 B2
(45) Date of Patent: May 15, 2012

(54) MAGENTA TONER AND DEVELOPER

(75) Inventors: Naohiro Watanabe, Shizuoka-ken (JP); Shinichi Wakamatsu, Numazu (JP); Naohito Shimota, Numazu (JP); Hiroshi Yamashita, Numazu (JP); Tsuyoshi Sugimoto, Mishima (JP); Masaki Watanabe, Numazu (JP); Tsuneyasu Nagatomo, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 344 days.

(21) Appl. No.: 12/567,831

(22) Filed: Sep. 28, 2009

(65) Prior Publication Data

US 2010/0081075 A1 Apr. 1, 2010

(30) Foreign Application Priority Data

Sep. 26, 2008 (JP) ..... 2008-247294

(51) Int. Cl.
*G03G 9/00* (2006.01)

(52) U.S. Cl. ..... 430/108.1; 430/137.1; 430/137.15; 430/137.17

(58) Field of Classification Search ..... 430/108.1, 430/137.1, 137.15, 137.17
See application file for complete search history.

(56) References Cited

U.S. PATENT DOCUMENTS 4,197,404 A * 4/1980 Johnson ..... 546/49
5,368,972 A 11/1994 Yamashita et al.
5,868,828 A * 2/1999 Badejo et al. ..... 106/497
6,140,000 A 10/2000 Yamashita
6,329,115 B1 12/2001 Yamashita
6,360,068 B1 3/2002 Kinoshita et al.
6,403,275 B1 6/2002 Kuramoto et al.
6,416,914 B1 7/2002 Nakamura et al.
6,432,589 B1 8/2002 Uchinokura et al.
6,503,676 B2 1/2003 Yamashita et al.
6,660,443 B2 12/2003 Sugiyama et al.
6,682,866 B2 1/2004 Sugiyama et al.
6,740,460 B2 5/2004 Tomita et al.
6,756,175 B2 6/2004 Emoto et al.
6,757,507 B2 6/2004 Mochizuki et al.
6,787,280 B2 9/2004 Yamashita et al.
6,824,945 B2 11/2004 Emoto et al.
6,846,604 B2 1/2005 Emoto et al.
6,849,369 B2 2/2005 Yagi et al.
6,852,462 B2 2/2005 Emoto et al.
6,855,468 B1 2/2005 Yamamoto et al.
6,887,636 B2 5/2005 Matsuda et al.
6,898,406 B2 5/2005 Suzuki et al.
6,902,857 B2 6/2005 Yagi et al.
6,924,073 B2 8/2005 Higuchi et al.
6,936,390 B2 8/2005 Nanya et al.
6,946,229 B2 9/2005 Suzuki et al.
6,947,692 B2 9/2005 Kondo et al.
7,005,223 B2 2/2006 Yamashita et al.
7,056,635 B2 6/2006 Tanaka et al.
7,056,636 B2 6/2006 Tomita et al.
7,056,638 B1 6/2006 Tomita et al.
7,074,535 B2 7/2006 Saito et al.
7,074,541 B2 7/2006 Yamashita et al.
7,083,890 B2 8/2006 Emoto et al.
7,129,013 B2 10/2006 Higuchi et al.
7,157,199 B2 1/2007 Emoto et al.
7,157,201 B2 1/2007 Tomita et al.
7,163,775 B2 1/2007 Takada et al.
7,208,256 B2 4/2007 Tanaka et al.
7,241,545 B2 7/2007 Nanya et al.
7,241,548 B2 7/2007 Sugiyama et al.
7,303,847 B2 12/2007 Tomita et al.
7,306,887 B2 12/2007 Tanaka et al.
7,348,117 B2 3/2008 Inoue et al.
7,354,690 B2 4/2008 Ishii et al.
7,374,848 B2 5/2008 Matsuoka et al.
7,374,851 B2 5/2008 Nakayama et al.
7,384,722 B2 6/2008 Ohtani et al.
7,396,627 B2 7/2008 Watanabe et al.
7,429,442 B2 9/2008 Honda et al.
7,435,521 B2 10/2008 Yagi et al.
7,437,111 B2 10/2008 Yamada et al.
7,449,273 B2 11/2008 Ohki et al.
7,455,942 B2 11/2008 Nagatomo et al.
7,459,255 B2 12/2008 Tanaka et al.
7,473,508 B2 1/2009 Higuchi et al.
7,488,564 B2 2/2009 Tanaka et al.
7,504,188 B2 3/2009 Yamada et al.

(Continued)

FOREIGN PATENT DOCUMENTS

JP 2537503 7/1996
JP 2001-66827 3/2001
JP 2003-202706 7/2003
JP 2003-215847 7/2003

(Continued)

OTHER PUBLICATIONS

Description of ISO/Japan Color Offset Sheet Printing Color Standard Japan Color Color-Reproduction Printing 2001; The Japan Society of Printing Science and Technology, Japan Printing Machinery Association and Japanese domestic committee of International Standardization Organization print technology committee ISO/TC 130 w/partial English translation.
International Standard ISO 12647-1, Jan. 8, 2004.
International Standard ISO 12647-2, Nov. 15, 2004.
U.S. Appl. No. 12/403,569, filed Mar. 13, 2009, Watanabe, et al.
U.S. Appl. No. 12/492,511, filed Jun. 26, 2009, Watanabe, et al.

(Continued)

*Primary Examiner* — Thorl Chea
(74) *Attorney, Agent, or Firm* — Oblon, Spivak, McClelland, Maier & Neustadt, L.L.P.

(57) ABSTRACT

A magenta toner, produced by a method including suspending an oily liquid comprising a binder resin and a colorant in an aqueous medium, wherein the colorant comprises a naphthol pigment and a quinacridone pigment, and the quinacridone pigment comprises a pigment having a specific formula.

18 Claims, 1 Drawing Sheet

U.S. PATENT DOCUMENTS

| | | | | |
|---|---|---|---|---|
| 7,531,279 | B2 | 5/2009 | Watanabe et al. | |
| 7,541,128 | B2 | 6/2009 | Watanabe et al. | |
| 7,550,245 | B2 | 6/2009 | Inoue et al. | |
| 7,560,216 | B2 | 7/2009 | Sugiyama et al. | |
| 7,587,161 | B2 | 9/2009 | Yamada et al. | |
| 2002/0039698 | A1 | 4/2002 | Sasaki et al. | |
| 2003/0027066 | A1 | 2/2003 | Yamashita et al. | |
| 2003/0055159 | A1 | 3/2003 | Yamashita et al. | |
| 2003/0096185 | A1 | 5/2003 | Yamashita et al. | |
| 2003/0219669 | A1 | 11/2003 | Yamashita et al. | |
| 2004/0115551 | A1 | 6/2004 | Sugiyama et al. | |
| 2005/0079433 | A1 | 4/2005 | Watanabe et al. | |
| 2005/0112488 | A1 | 5/2005 | Yamada et al. | |
| 2005/0164112 | A1 | 7/2005 | Ohki et al. | |
| 2005/0196691 | A1 | 9/2005 | Ohtani et al. | |
| 2005/0277045 | A1 | 12/2005 | Saito et al. | |
| 2006/0046178 | A1* | 3/2006 | Akiyama et al. | 430/108.23 |
| 2006/0057488 | A1 | 3/2006 | Inoue et al. | |
| 2006/0068312 | A1 | 3/2006 | Yamashita et al. | |
| 2006/0177756 | A1 | 8/2006 | Sugimoto et al. | |
| 2006/0210903 | A1 | 9/2006 | Ohki et al. | |
| 2007/0015077 | A1 | 1/2007 | Yamashita et al. | |
| 2007/0054210 | A1 | 3/2007 | Ohki et al. | |
| 2007/0059626 | A1 | 3/2007 | Inoue et al. | |
| 2007/0141500 | A1 | 6/2007 | Sugimoto et al. | |
| 2007/0218380 | A1 | 9/2007 | Uchinokura et al. | |
| 2007/0218381 | A1 | 9/2007 | Uchinokura et al. | |
| 2007/0218382 | A1 | 9/2007 | Emoto et al. | |
| 2007/0218383 | A1 | 9/2007 | Seshita et al. | |
| 2007/0218385 | A1 | 9/2007 | Kojima et al. | |
| 2007/0218386 | A1 | 9/2007 | Suzuki et al. | |
| 2007/0218387 | A1 | 9/2007 | Ishii et al. | |
| 2007/0218392 | A1 | 9/2007 | Yamada et al. | |
| 2007/0275315 | A1 | 11/2007 | Nagatomo et al. | |
| 2008/0069606 | A1 | 3/2008 | Yamashita et al. | |
| 2008/0069616 | A1 | 3/2008 | Kojima et al. | |
| 2008/0070144 | A1 | 3/2008 | Nagatomo et al. | |
| 2008/0070151 | A1 | 3/2008 | Sugimoto et al. | |
| 2008/0227002 | A1 | 9/2008 | Moriya et al. | |
| 2008/0227015 | A1 | 9/2008 | Nagatomo et al. | |
| 2008/0233496 | A1 | 9/2008 | Kotsugai et al. | |
| 2008/0233505 | A1 | 9/2008 | Nagatomo et al. | |
| 2008/0280218 | A1 | 11/2008 | Sabu et al. | |
| 2008/0280219 | A1 | 11/2008 | Nakayama et al. | |
| 2008/0292985 | A1 | 11/2008 | Suzuki et al. | |
| 2008/0318144 | A1 | 12/2008 | Watanabe et al. | |
| 2008/0318148 | A1 | 12/2008 | Sugimoto et al. | |
| 2009/0003885 | A1 | 1/2009 | Sabu et al. | |
| 2009/0067876 | A1 | 3/2009 | Seshita et al. | |
| 2009/0074467 | A1 | 3/2009 | Seshita et al. | |
| 2009/0092917 | A1 | 4/2009 | Sugimoto et al. | |
| 2009/0104555 | A1 | 4/2009 | Wakamatsu et al. | |
| 2009/0142093 | A1 | 6/2009 | Sawada et al. | |
| 2009/0142094 | A1 | 6/2009 | Sawada et al. | |
| 2009/0142680 | A1 | 6/2009 | Shimota et al. | |
| 2009/0142685 | A1 | 6/2009 | Nagatomo et al. | |
| 2009/0142686 | A1 | 6/2009 | Kojima et al. | |
| 2009/0155709 | A1 | 6/2009 | Watanabe et al. | |
| 2009/0214973 | A1 | 8/2009 | Sugimoto et al. | |

FOREIGN PATENT DOCUMENTS

| | | |
|---|---|---|
| JP | 2004-77664 | 3/2004 |
| JP | 3661422 | 4/2005 |
| JP | 3870050 | 10/2006 |

* cited by examiner

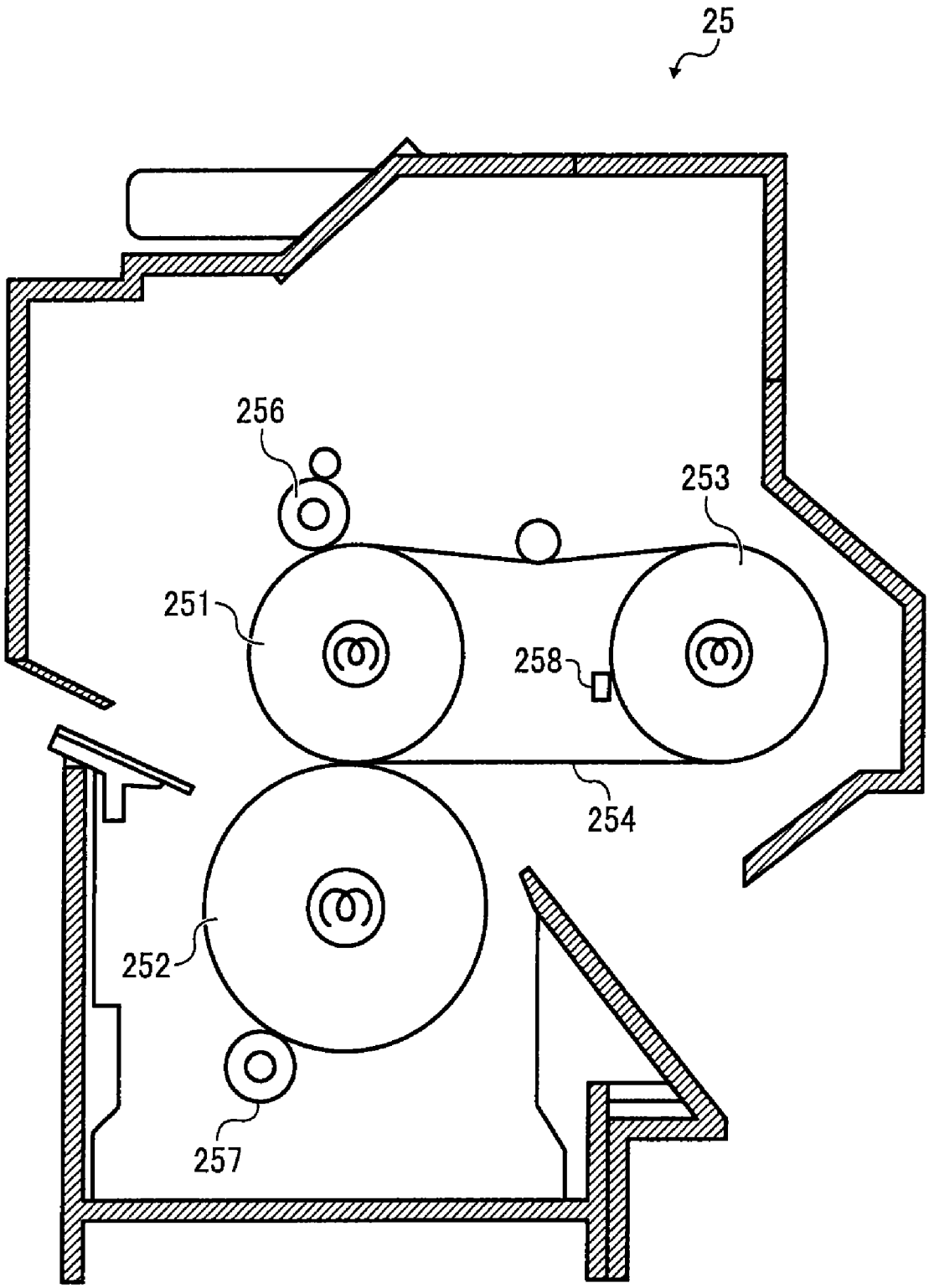
25
256
253
251
258
254
252
257

MAGENTA TONER AND DEVELOPER

BACKGROUND OF THE INVENTION

1. Field of the Invention

The present invention relates to a magenta toner and a magenta developer for developing electrostatic images in electrophotography, electrostatic recording, and electrostatic printing.

2. Discussion of the Background

In electrophotographic image forming apparatuses and electrostatic recording apparatuses, electric or magnetic latent images are formed into visible images with toner. Specifically, in electrophotographic image forming apparatuses, an electrostatic latent image is formed on a photoreceptor and is developed with a toner to form a toner image. The toner image is transferred onto a transfer medium and is fixed thereon by application of heat, etc.

A typical toner for developing electrostatic latent images is comprised of colored particles comprising a binder resin and additives such as a colorant and a charge controlling agent. Methods of producing toner are broadly classified into pulverization methods and suspension polymerization methods.

In pulverization methods, raw materials such as a binder resin (typically a thermoplastic resin), a colorant, a charge controlling agent, an offset inhibitor, etc., are melt-kneaded. The melt-kneaded mixture is pulverized into particles, and the particles are classified by size to obtain a desired-size toner.

Pulverization methods generally provide toners having good properties. However, the range of choice for raw materials is narrow. For example, it is preferable that the melt-kneaded mixture can be pulverized using economical apparatuses. From this viewpoint, raw materials should be chosen so that the melt-kneaded mixture is made as brittle as possible.

Disadvantageously, such a brittle melt-kneaded mixture may be pulverized into particles with a wide size distribution. To obtain a toner which provides high-resolution and high-gradation images, ultrafine particles having a particle diameter of 5 μm or less, preferably 3 μm or less, and coarse particles having a particle diameter of 20 μm or more may be removed, for example, but this results in an extremely low yield.

Pulverization methods have another disadvantage that it is difficult to evenly disperse additives such as a colorant and a charge controlling agent in a binder resin. Therefore, the colorant may disadvantageously expose at the surface of a toner, degrading chargeability of the toner.

As just described, pulverization methods do not satisfactorily respond to recent demands for high-performance toner yet.

To overcome these disadvantages of pulverization methods, suspension polymerization methods have been proposed.

Suspension polymerization methods generally provide spherical toners. Disadvantageously, spherical toners are difficult to remove from the surface of photoreceptors.

When an image with a low toner image area ratio is transferred, only a slight amount of toner particles may remain on the photoreceptor, which may cause no problem. By comparison, when an image with a high toner image area ratio, such as a picture image, is transferred, a relatively large amount of toner particles may remain on the photoreceptor. In this case, the resultant image background may be contaminated with toner particles. This phenomenon is hereinafter referred to as "background fouling". Additionally, charging members for charging the photoreceptor may be also contaminated with toner particles, degrading charging ability of the charging members.

In suspension polymerization methods, a polymerization reaction for producing a resin is performed simultaneously with production of toner particles. For this reason, most of the raw materials which are conventionally used for pulverization methods may not be directly applied to suspension polymerization methods. Even in a case in which conventionally-used raw materials are applied to suspension polymerization methods, the particle diameter of the resultant toner particles may not be controlled as desired under the influence of additives such as a resin and a colorant. It may be said that usable materials for suspension polymerization methods are limited.

Because polyester resins that provide excellent fixing and color properties cannot be used for suspension polymerization methods, suspension polymerization methods cannot contribute to downsizing, speeding-up, and colorization of image forming apparatuses. In attempting to solve this problem of suspension polymerization methods, Japanese Patent No. (hereinafter "JP") 2537503 discloses a toner production method in which fine resin particles obtained by an emulsion polymerization are coalesced to form toner particles. This method produces irregular-shaped toner particles.

However, this method has a disadvantage that surfactants that are used in the emulsion polymerization may remain in large amounts both on the surface and inside of the toner particles even when the toner particles are subjected to washing with water. Therefore, the resultant toner may have poor chargeability and the resultant image background may be contaminated with toner particles. The remaining surfactants may also contaminate photoreceptors, charging members, and developing members. In addition, colorants may aggregate in the toner particles, which results in deterioration of chargeability of the toner.

In full-color image formation, slight deterioration in developability or transferability of toner may cause significant deterioration in color balance and gradation of the resultant image.

Generally, colorants are hydrophilic and incompatible with resins. Therefore, transmitted light is reflected diffusely at an interface between the colorant and the resin. Accordingly, colorants generally degrade transparency of toner, which results in low transmittance of an OHP (overhead projector) sheet when a toner image is formed thereon. When colorants are not finely dispersed in toner, transmittance of an OHP (overhead projector) sheet may be much lower.

Unexamined Japanese Patent Application Publication No. (hereinafter "JP-A") discloses a toner production method which includes steps of dissolving or dispersing a pigment which is surface-treated with a fatty acid and a pigment dispersing agent in a first organic solvent which solubilizes a binder resin, to prepare a pigment dispersion; mixing the binder resin and the pigment dispersion with a second organic solvent to prepare an oily component; suspending the oily component in an aqueous medium to form fine particles; and removing the organic solvents from the resultant suspension to obtain toner particles. Although the pigment is surface-treated with a fatty acid, the fatty acid does not include an amino group that is capable of controlling chargeability of toner.

JP 3661422 discloses a toner which includes a polymer dispersant as a pigment dispersing agent. It is disclosed therein that the acid value and amine value of the polymer dispersant are specified so that the resultant toner has a good combination of offset resistance, chargeability, storage stability, and coloring property, and transparency. However, it may be said that storage stability is not satisfactory.

This toner further includes a synergist, which is a derivative of a pigment, as an auxiliary pigment dispersing agent. A synergist is produced by introducing a polar group to a pigment, and improves interactions between the pigment and pigment dispersing agents so that the pigment is finely dispersed in toner.

However, there is a problem that synergists allow pigments to migrate to the surface of the resultant toner or to an aqueous medium when the toner is produced in the aqueous medium. This may be because synergists have a polar group, as described above, and the polar group generally has hydrophilicity. Synergists adsorb to pigments while the polar group is hydrophilic. Therefore, pigments may migrate to the surface of the resultant toner or to an aqueous medium. In this case, the resultant toner may have poor coloring power and poor fixing property, and pigments are likely to contaminate other members.

Recently, toners for producing full-color images generally include a release agent to eliminate oil applicators from fixing devices. Such toners including a release agent are hereinafter referred to as "oil-less toners". Release agents are more difficult to evenly disperse in toner compared to colorants. When release agents are unevenly dispersed in toner, chargeability, developability, storage stability, and transparency may be poor.

In the field of process printing, yellow, magenta, and cyan compose the three primary colors.

Pigments are widely used as colorants in various fields of image recording methods, such as conventional printing using plates, electrophotographic recording, ink-jet recording, and thermal transfer recording.

stability and low hydrophilicity, which are usable pigments for toner production methods using aqueous medium.

Quinacridone pigments have been widely used as magenta pigments from the viewpoint of their color hue and light stability. However, the coloring power of quinacridone pigments is poor, and therefore a naphthol pigment C. I. Pigment Red 269 is also widely used. Since C. I. Pigment Red 269 is more reddish compared to the standard magenta color on art paper that is standardized in Japan Color, there have been attempts to use a naphthol pigment and a quinacridone pigment in combination, as disclosed in JP-A 2003-215847 and JP-A 2003-202706. However, because the backbone structures of naphthol pigments and quinacridone pigments are different, their combinations may degrade transparency and color saturation.

Because of these reasons, an electrophotographic magenta toner which can respond to recent demands for high-performance toner is still needed.

SUMMARY OF THE INVENTION

Accordingly, an object of the present invention is to provide a magenta toner which can reproduce the standard magenta color on art paper that is standardized in ISO/Japan Color. The toner also provides a good combination of offset resistance, chargeability, and storage stability without adversely affecting the environment and the human body.

These and other objects of the present invention, either individually or in combinations thereof, as hereinafter will become more readily apparent can be attained by a magenta toner, produced by a method comprising:

suspending an oily liquid comprising a binder resin and a colorant in an aqueous medium, wherein the colorant comprises a naphthol pigment and a quinacridone pigment, and wherein the quinacridone pigment comprises a pigment having the following formula (1):

(1)

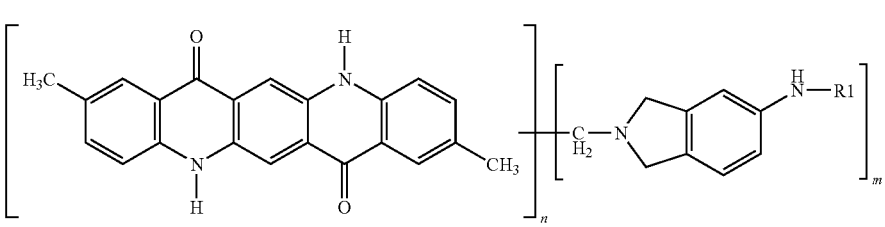

To more improve reproducibility of color in the above image recording methods, demands for vivid and transparent image recording agents of yellow, magenta, and cyan are increasing.

A document "Description of ISO/Japan Color Offset Sheet Printing Color Standard Japan Color Color-Reproduction Printing 2001 (The Japanese Society of Printing Science and Technology, Japan Printing Machinery Association, and Japanese domestic committee of International Standardization Organization print technology committee ISO/TC 130)" describes ISO/Japan Color and provides standard inks, standard papers, and standard colors.

Among the standard papers, art paper is the best at reproducing color. However, it is difficult for conventional electrophotographic magenta toners to reproduce coloring power, color saturation, and color hue even on art paper.

In particular, there has been no magenta pigment which can reproduce the standard magenta color on art paper that is standardized in Japan Color among pigments with low light wherein n represents a natural number of from 1 to 3, m represents a natural number of from 1 to 6, and R1 represents a hydrogen atom, an alkyl group, a methoxy group, or a group having the following formula (2):

(2)

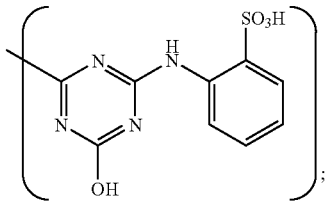

and a developer including the above toner.

BRIEF DESCRIPTION OF THE DRAWING

These and other objects, features and advantages of the present invention will become apparent upon consideration of the following description of the preferred embodiments of the present invention taken in conjunction with the accompanying drawings, wherein:

FIGURE is a schematic view illustrating an embodiment of a fixing device used for toner evaluation.

DETAILED DESCRIPTION OF THE INVENTION

The toner of the present invention comprises a binder resin and a colorant.

The colorant includes a quinacridone pigment having the formula (1) to reproduce the magenta color that is standardized by Japan Color on art paper.

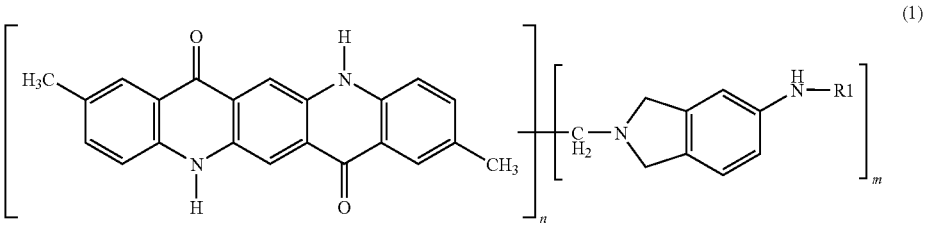

(1)

The colorant further includes a naphthol pigment from the viewpoint of its coloring power. The naphthol pigment is preferably C. I. Pigment Red 269, but is not limited thereto. Preferably, the colorant further includes a quinacridone pigment C. I. Pigment Violet 19. The quinacridone pigment having the formula (1) does not degrade its color saturation even under the influence of intermolecular interactions with naphthol pigments and/or C. I. Pigment Violet 19.

With regard to magenta toners produced by suspending an oily liquid comprising a binder resin and a colorant in an aqueous medium, the colorant is dispersed in a solvent, preferably along with a colorant dispersing agent. In the absence of a colorant dispersing agent, generally, color saturation, coloring power, and transparency of the resultant toner may deteriorate.

The quinacridone pigment having the formula (1) can be finely and evenly dispersed in solvents without a pigment dispersing agent. Therefore, a toner including the quinacridone pigment having the formula (1) provides a good combination of color saturation, coloring power, and transparency even without a pigment dispersing agent.

R1 in the formula (1) is preferably the group having the formula (2). Alternatively, each of multiple R1's may be the group having the formula (2) or a hydrogen atom, independently.

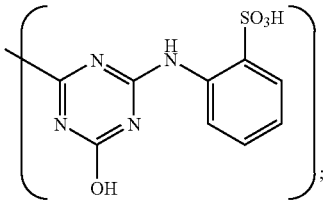

(2)

In the formula (1), n represents a natural number of from 1 to 3 and m represents a natural number of from 1 to 4. The quinacridone pigment having the formula (1) includes a mixture which includes all possible combinations of n and m.

The sulfonic acid group in the formula (2) may be in the form of a metal salt with Mn, Sr, Ba, Ca, K, Na, etc., or an amine salt with dehydroabietylamine, stearylamine, etc.

When the naphthol pigment is C. I. Pigment Red 269, the weight ratio of the quinacridone pigment having the formula (1) to the naphthol pigment C. I. Pigment Red 269 is preferably from 1/99 to 50/50, more preferably from 5/95 to 40/60, and most preferably from 5/95 to 35/65.

When the quinacridone pigments C. I. Pigment Red 122 and C. I. Pigment Violet 19 are used in combination with the quinacridone pigment having the formula (1) and the naphthol pigment C. I. Pigment Red 269, the ratio of the total weight of the quinacridone pigments (i.e., the quinacridone pigment having the formula (1), C. I. Pigment Red 122, and C. I. Pigment Violet 19) to the weight of the naphthol pigment C. I. Pigment Red 269 is preferably from 1/99 to 80/20, more preferably from 5/95 to 70/30, and most preferably from 5/95 to 50/50.

Additionally, the weight ratio of the quinacridone pigment having the formula (1) to the other quinacridone pigments (i.e., C. I. Pigment Red 122 and C. I. Pigment Violet 19) is preferably from 1/99 to 80/20, more preferably from 10/85 to 65/35, and most preferably from 25/75 to 60/40.

The toner preferably includes the colorant in an amount of from 1 to 20% by weight, and more preferably from 3 to 15% by weight. When the amount of the colorant is too small, coloring power of the toner may be poor. When the amount of the colorant is too large, the colorant may not be evenly dispersed in the toner and coloring power and electric properties of the toner may be poor.

The toner of the present invention is produced by suspending an oily liquid comprising a binder resin and a colorant in an aqueous medium.

More specifically, the toner of the present invention may be produced by emulsifying or dispersing a solution or dispersion of the toner components in an aqueous medium.

The solution of toner components is prepared by dissolving toner components in a solvent. The dispersion of toner components is prepared by dispersing toner components in a solvent. The solution of toner components and dispersion of toner components are hereinafter collectively referred to as "toner components liquid".

The toner components include at least one of a monomer, a polymer, a compound having an active hydrogen group, and a polymer reactive with the compound having an active hydrogen group, and a colorant. The toner components optionally include a colorant dispersing agent, a release agent (e.g., a wax), a charge controlling agent, etc.

The toner components liquid preferably includes an organic solvent. In other words, the toner components are preferably dissolved or dispersed in an organic solvent.

The organic solvents are preferably removed after toner particles are formed.

Organic solvents having a boiling point of less than 150° C. are preferable for dissolving or dispersing toner components because such organic solvents are easily removable in succeeding processes. Specific examples of usable organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Among these organic solvents, toluene, xylene, benzene, methylene chloride, 1,2-dichloroethane, chloroform, and carbon tetrachloride are preferable, and ethyl acetate is most preferable. These organic solvents can be used alone or in combination.

The toner components liquid preferably includes the organic solvent in an amount of from 40 to 300 parts by weight, more preferably from 60 to 140 parts by weight, and most preferably from 80 to 120 parts by weight, based on 100 parts by weight of the toner components.

The aqueous medium may be water, a water-miscible solvent, or a mixture thereof, for example. Preferably, the aqueous medium is water.

Specific examples of usable water-miscible solvents include, but are not limited to, alcohols, dimethylformamide, tetrahydrofuran, cellosolves, and lower ketones.

Specific examples of usable alcohols include, but are not limited to, methanol, isopropanol, and ethylene glycol. Specific examples of usable lower ketones include, but are not limited to, acetone and methyl ethyl ketone. These compounds can be used alone or in combination.

It is preferable that the aqueous medium is agitated while the toner components liquid is dispersed or emulsified in the aqueous medium. The aqueous medium may be agitated with a low-speed shearing-type disperser, a high-speed shearing-type disperser, a friction-type disperser, a high-pressure jet-type disperser, or an ultrasonic disperser, for example. Among these dispersers, high-speed shearing-type dispersers are preferable because dispersoids (i.e., liquid droplets of the toner components liquid) can be controlled to have particle diameters of from 2 to 20 μm.

The revolution number, dispersing time, and dispersing temperature of the high-speed shearing-type disperser are not limited. However, the revolution number is preferably from 1,000 to 30,000 rpm, more preferably from 5,000 to 20,000 rpm. The dispersing time is preferably from 0.5 minutes to 1 minute, when the high-speed shearing-type disperser is batch-type. The dispersing temperature is preferably from 0 to 150° C., more preferably from 40 to 98° C., under pressure. Generally, the higher the dispersing temperature, the easier the dispersing.

To form toner particles, for example, a suspension polymerization method, an emulsion polymerization aggregation method, a dissolution suspension method, and a method in which an adhesive base material is produced while toner particles comprising the produced adhesive base material are formed (to be described in later) may be applied. Among these methods, the method in which an adhesive base material is produced while toner particles comprising the produced adhesive base material are formed is preferable.

In a suspension polymerization method, a colorant, a release agent, etc., are dispersed in a mixture of an oil-soluble polymerization initiator and a polymerizable monomer, and the resultant mixture is emulsified or dispersed in an aqueous medium including a surfactant, a solid dispersing agent, etc., to perform a polymerization reaction. The resultant toner particles are subjected to a wet process for adhering fine particles of an inorganic material to the surfaces of the toner particles. It is preferable that excessive surfactant, dispersing agent, etc., are washed away in advance of the wet process.

Specific examples of usable polymerizable monomers include, but are not limited to, acids such as acrylic acid, methacrylic acid, α-cyanoacrylic acid, α-cyanomethacrylic acid, itaconic acid, crotonic acid, fumaric acid, maleic acid, and maleic anhydride; acrylamide, methacrylamide, and diacetone acrylamide, and methylol compounds thereof; and vinyl pyridine, vinyl pyrrolidone, vinyl imidazole, and ethylene imine. Acrylates or methacrylates having an amino group such as dimethylaminoethyl methacrylate are also usable for introducing functional groups on the surface of toner.

When the dispersing agent in the aqueous medium has an acid group or a basic group, the dispersing agents may adsorb to and remain on the surfaces of toner particles, thereby introducing functional groups thereto.

In an emulsion polymerization aggregation method, first, a water-soluble polymerization initiator and a polymerizable monomer are emulsified in water in the presence of a surfactant to prepare a latex. This process is a typical emulsion polymerization.

A colorant dispersion in which a colorant is dispersed in an aqueous medium and a release agent dispersion in which a release agent is dispersed in an aqueous medium are prepared separately. The latex, the colorant dispersion, and the release agent dispersion are mixed so that the dispersoids form aggregations having substantially the same size as a desired toner particle. The aggregations are heated so that the dispersoids are coalesced, thereby forming toner particles. The toner particles are subjected to a wet process for adhering fine particles of an inorganic material to the surfaces of the toner particles. Usable polymerizable monomers for emulsion polymerization aggregation methods are the same as those for suspension polymerization methods.

In a method in which an adhesive base material is produced while toner particles comprising the produced adhesive base material are formed, specifically, a compound having an active hydrogen group and a polymer reactive with the compound having an active hydrogen group are subjected to a reaction in an aqueous medium to produce an adhesive base material, while toner particles comprising the produced adhesive base material are formed. The resultant toner particles include the adhesive base material, and optional components such as a colorant, a colorant dispersing agent, a release agent, and a charge controlling agent.

The adhesive base material may exhibit adhesiveness to recording media such as paper. The adhesive base material includes an adhesive polymer that is a reaction product of the compound having an active hydrogen group and the polymer reactive with the compound having an active hydrogen group, and optionally includes another binder resin.

The adhesive base material preferably has a weight average molecular weight of 3,000 or more, more preferably from 5,000 to 1,000,000, and most preferably from 7,000 to 500,000. When the weight average molecular weight is too small, hot offset resistance of the resultant toner may be poor.

The adhesive base material preferably has a glass transition temperature of from 40 to 65° C., and more preferably from 45 to 65° C. When the glass transition temperature is too small, heat-resistant storage stability of the resultant toner may be poor. When the glass transition temperature is too large, low-temperature fixability of the resultant toner may be poor. A toner including cross-linked and/or elongated polyester resins as the adhesive base material has good storage stability even when the glass transition temperature of the adhesive base material is low.

Specific preferred examples of the adhesive base material include polyester-based resins, but are not limited thereto.

Specific preferred examples of the polymer reactive with a compound having an active hydrogen group include modified polyester-based resins reactive with a compound having an active hydrogen group, but are not limited thereto.

Specific preferred examples of the modified polyester-based resin reactive with a compound having an active hydrogen group include polyester resins having an isocyanate group, but are not limited thereto.

A polyester resin having an isocyanate group may react with a compound having an active hydrogen group in the presence of an alcohol so that urethane bonds are formed. In this case, the molar ratio of urea bonds to urethane bonds is preferably from 0 to 9, more preferably from 1/4 to 4, and most preferably from 2/3 to 7/3. When the molar ratio is too large, hot offset resistance of the resultant toner may be poor.

Specific examples of the adhesive base material include, but are not limited to, the following:

(1) A mixture of an urea-modified polyester produced by reacting isophorone diamine with a polyester prepolymer produced by reacting isophorone diisocyanate with a polycondensation product of ethylene oxide 2 mol adduct of bisphenol A with isophthalic acid, and a polycondensation product of ethylene oxide 2 mol adduct of bisphenol A with isophthalic acid;

(2) A mixture of an urea-modified polyester produced by reacting isophorone diamine with a polyester prepolymer produced by reacting isophorone diisocyanate with a polycondensation product of ethylene oxide 2 mol adduct of bisphenol A with isophthalic acid, and a polycondensation product of ethylene oxide 2 mol adduct of bisphenol A with terephthalic acid;

(3) A mixture of an urea-modified polyester produced by reacting isophorone diamine with a polyester prepolymer produced by reacting isophorone diisocyanate with a polycondensation product of ethylene oxide 2 mol adduct of bisphenol A/propylene oxide 2 mol adduct of bisphenol A with terephthalic acid, and a polycondensation product of ethylene oxide 2 mol adduct of bisphenol A/propylene oxide 2 mol adduct of bisphenol A with terephthalic acid;

(4) A mixture of an urea-modified polyester produced by reacting isophorone diamine with a polyester prepolymer produced by reacting isophorone diisocyanate with a polycondensation product of ethylene oxide 2 mol adduct of bisphenol A/propylene oxide 2 mol adduct of bisphenol A with terephthalic acid, and a polycondensation product of ethylene oxide 2 mol adduct of bisphenol A with terephthalic acid;

(5) A mixture of an urea-modified polyester produced by reacting hexamethylene diamine with a polyester prepolymer produced by reacting isophorone diisocyanate with a polycondensation product of ethylene oxide 2 mol adduct of bisphenol A with terephthalic acid, and a polycondensation product of ethylene oxide 2 mol adduct of bisphenol A with terephthalic acid;

(6) A mixture of an urea-modified polyester produced by reacting hexamethylene diamine with a polyester prepolymer produced by reacting isophorone diisocyanate with a polycondensation product of ethylene oxide 2 mol adduct of bisphenol A with terephthalic acid, and a polycondensation product of ethylene oxide 2 mol adduct of bisphenol A/propylene oxide 2 mol adduct of bisphenol A with terephthalic acid;

(7) A mixture of an urea-modified polyester produced by reacting ethylene diamine with a polyester prepolymer produced by reacting isophorone diisocyanate with a polycondensation product of ethylene oxide 2 mol adduct of bisphenol A with terephthalic acid, and a polycondensation product of ethylene oxide 2 mol adduct of bisphenol A with terephthalic acid;

(8) A mixture of an urea-modified polyester produced by reacting hexamethylene diamine with a polyester prepolymer produced by reacting diphenylmethane diisocyanate with a polycondensation product of ethylene oxide 2 mol adduct of bisphenol A with isophthalic acid, and a polycondensation product of ethylene oxide 2 mol adduct of bisphenol A with isophthalic acid;

(9) A mixture of an urea-modified polyester produced by reacting hexamethylene diamine with a polyester prepolymer produced by reacting diphenylmethane diisocyanate with a polycondensation product of ethylene oxide 2 mol adduct of bisphenol A/propylene oxide 2 mol adduct of bisphenol A with terephthalic acid/dodecenylsuccinic anhydride, and a polycondensation product of ethylene oxide 2 mol adduct of bisphenol A/propylene oxide 2 mol adduct of bisphenol A with terephthalic acid; and

(10) A mixture of an urea-modified polyester produced by reacting hexamethylene diamine with a polyester prepolymer produced by reacting toluene diisocyanate with a polycondensation product of ethylene oxide 2 mol adduct of bisphenol A with isophthalic acid, and a polycondensation product of ethylene oxide 2 mol adduct of bisphenol A with isophthalic acid.

The compound having an active hydrogen group functions as an elongation agent or a cross-linking agent for elongating or cross-linking the polymer reactive with a compound having an active hydrogen group in an aqueous medium.

The active hydrogen group may be a hydroxyl group (e.g., an alcoholic hydroxyl group, a phenolic hydroxyl group), an amino group, a carboxyl group, and a mercapto group, for example. The active hydrogen group may be a single functional group or a combination of 2 or more functional groups.

When the polymer reactive with a compound having an active hydrogen group is a polyester resin having an isocyanate group, the compound having an active hydrogen group is preferably an amine, because amines are capable of elongating or cross-linking the polyester resin having an isocyanate group to produce a high-molecular-weight polymer.

A polymer reactive with a compound having an active hydrogen group may be hereinafter referred to as a "prepolymer".

Specific examples of usable amines include, but are not limited to, diamines, polyamines having 3 or more valences, amino alcohols, amino mercaptans, amino acids, and blocked amines in which the amino groups in the above amines are blocked. Among these amines, a diamine alone and a mixture of a diamine with a small amount of a polyamine having 3 or more valences are preferable. These compounds can be used alone or in combination.

Specific examples of usable diamines include, but are not limited to, aromatic diamines, alicyclic diamines, and aliphatic diamines.

Specific examples of usable aromatic diamines include, but are not limited to, phenylene diamine, diethyltoluene diamine, and 4,4'-diamino diphenylmethane.

Specific examples of usable alicyclic diamines include, but are not limited to, 4,4'-diamino-3,3'-dimethyldicyclohexylmethane, diamine cyclohexane, and isophorone diamine.

Specific examples of usable aliphatic diamines include, but are not limited to, ethylene diamine, tetramethylene diamine, and hexamethylene diamine.

Specific examples of usable polyamines having 3 or more valences include, but are not limited to, diethylene triamine and triethylene tetramine.

Specific examples of usable amino alcohols include, but are not limited to, ethanolamine and hydroxyethyl aniline.

Specific examples of usable amino mercaptans include, but are not limited to, aminoethyl mercaptan and aminopropyl mercaptan.

Specific examples of usable amino acids include, but are not limited to, amino propionic acid and amino caproic acid.

Specific examples of the blocked amines in which the amino groups in the above amines are blocked include, but are not limited to, ketimine compounds obtained by blocking amino groups in the above amines with ketones such as acetone, methyl ethyl ketone, and methyl isobutyl ketone; and oxazoline compounds.

To terminate an elongation reaction and/or a cross-linking reaction between the compound having an active hydrogen group and the polymer reactive with the compound, for the purpose of controlling the molecular weight of the resultant resin, a reaction terminator may be used.

Specific examples of usable reaction terminators include, but are not limited to, monoamines (e.g., diethylamine, dibutylamine, butylamine, laurylamine) and those monoamines in which amino groups are blocked (e.g., ketimine compounds).

The equivalent ratio ([NCO]/[NHx]) of isocyanate groups in the polyester prepolymer to amino groups in the amine is preferably 1/3 to 3, more preferably 1/2 to 2, and most preferably 2/3 to 1.5. When the equivalent ratio ([NCO]/[NHx]) is too small, low-temperature fixability of the resultant toner may be poor. When the equivalent ratio ([NCO]/[NHx]) is too large, hot offset resistance of the resultant toner may be poor because the resultant binder resin (an urea-modified polyester resin) may have a low molecular weight.

The polymer reactive with a compound having an active hydrogen group (i.e., prepolymer) may be, for example, polyol resins, polyacrylic resins, polyester resins, epoxy resins, and derivative resins thereof. Among these resins, polyester resins are preferable because of exhibiting high fluidity and high transparency when melted. The above resins can be used alone or in combination.

The prepolymer has a site reactive with a compound having an active hydrogen group. The site may be, for example, an isocyanate group, an epoxy group, a carboxylic acid group, and a group represented by the chemical formula —COC—. Among these groups, isocyanate groups are preferable. The prepolymer may include one or more of the above groups.

Preferably, the prepolymer may be a polyester resin including a group capable of forming an urea group, such as an isocyanate group, because it is easy to control the molecular weight of such a polyester resin and the polyester resin may provide a wide fixable temperature range without applying oil to a fixing member.

A polyester prepolymer having an isocyanate group may be a reaction product of a polyester resin having an active hydrogen group, which is a polycondensation product of a polyol with a polycarboxylic acid, with a polyisocyanate, for example.

The polyol may be diols, polyols having 3 or more valences, and mixtures thereof, for example. Among these polyols, a diol alone and a mixture of a diol with a small amount of a polyol having 3 or more valences are preferable. These polyols can be used alone or in combination.

Specific examples of usable diols include, but are not limited to, alkylene glycols (e.g., ethylene glycol, 1,2-propylene glycol, 1,3-propylene glycol, 1,4-butanediol, 1,6-hexanediol), diols having an oxyalkylene group (e.g., diethylene glycol, triethylene glycol, dipropylene glycol, polyethylene glycol, polypropylene glycol, polytetramethylene ether glycol), alicyclic diols (e.g., 1,4-cyclohexanedimethanol, hydrogenated bisphenol A), alkylene oxide adducts of alicyclic diols (e.g., the above-described alicyclic diols to which an alkylene oxide such as ethylene oxide, propylene oxide, and butylene oxide is adducted), bisphenols (e.g., bisphenol A, bisphenol F, bisphenol S), and alkylene oxide adducts of bisphenols (e.g., the above-described bisphenols to which an alkylene oxide such as ethylene oxide, propylene oxide, and butylene oxide is adducted). Among these compounds, alkylene glycols having 2 to 12 carbon atoms, alkylene oxide adducts of alkylene glycols, and alkylene oxide adducts of bisphenols are preferable, and combinations of alkylene oxide adducts of bisphenols or alkylene oxide adducts of bisphenols with alkylene glycols having 2 to 12 carbon atoms are more preferable.

Specific examples of usable polyols having 3 or more valences include, but are not limited to, polyvalent aliphatic alcohols having 3 or more valences, polyphenols having 3 or more valences, and alkylene oxide adducts of polyphenols having 3 or more valences.

Specific examples of usable polyvalent aliphatic alcohols having 3 or more valences include, but are not limited to, glycerin, trimethylolethane, trimethylolpropane, pentaerythritol, and sorbitol.

Specific examples of usable polyphenols having 3 or more valences include, but are not limited to, trisphenol PA, phenol novolac, and cresol novolac.

Specific examples of usable alkylene oxide adducts of polyphenols having 3 or more valences include, but are not limited to, the above-described polyphenols having 3 or more valences to which an alkylene oxide such as ethylene oxide, propylene oxide, and butylene oxide is adducted.

When a diol and a polyol having 3 or more valences are mixed, the mixing ratio of the polyol having 3 or more valences to the diol is preferably from 0.01 to 10% by weight, and more preferably from 0.01 to 1% by weight.

The polycarboxylic acid may be dicarboxylic acids, polycarboxylic acids having 3 or more valences, and mixtures thereof, for example. Among these polycarboxylic acids, a dicarboxylic acid alone and a mixture of a dicarboxylic acid with a small amount of a polycarboxylic acid having 3 or more valences are preferable. These polycarboxylic acids can be used alone or in combination.

Specific examples of usable dicarboxylic acids include, but are not limited to, divalent alkanoic acids, divalent alkenoic acid, and aromatic dicarboxylic acids.

Specific examples of usable divalent alkanoic acids include, but are not limited to, succinic acid, adipic acid, and sebacic acid.

Specific examples of usable divalent alkenoic acids include, but are not limited to, divalent alkenoic acids having 4 to 20 carbon atoms such as maleic acid and fumaric acid.

Specific examples of usable aromatic dicarboxylic acids include, but are not limited to, aromatic dicarboxylic acids having 8 to 20 carbon atoms such as phthalic acid, isophthalic acid, terephthalic acid, and naphthalenedicarboxylic acid.

Among these compounds, divalent alkenoic acids having 4 to 20 carbon atoms and aromatic dicarboxylic acids having 8 to 20 carbon atoms are preferable.

Specific examples of usable polycarboxylic acids having 3 or more valences include, but are not limited to, aromatic polycarboxylic acids having 9 to 20 carbon atoms such as trimellitic acid and pyromellitic acid.

Further, acid anhydrides and lower alkyl esters (e.g., methyl ester, ethyl ester, isopropyl ester) of the above-described dicarboxylic acids, polycarboxylic acids having 3 or more valences, and mixtures thereof may be also used as the polycarboxylic acid.

When a dicarboxylic acid and a polycarboxylic acid having 3 or more valences are mixed, the mixing ratio of the polycarboxylic acid having 3 or more valences to the dicarboxylic acid is preferably from 0.01 to 10% by weight, and more preferably from 0.01 to 1% by weight.

The equivalent ratio ([OH]/[COOH]) of hydroxyl group [OH] of the polyol to carboxyl group [COOH] of the polycarboxylic acid is typically from 1 to 2, preferably from 1 to 1.5, and more preferably from 1.02 to 1.3.

The polyester prepolymer having an isocyanate group preferably includes the polyol unit in an amount of from 0.5 to 40% by weight, more preferably from 1 to 30% by weight, and most preferably from 2 to 20% by weight. When the amount is too small, hot offset resistance and storage stability of the resultant toner may be poor. When the amount is too large, low-temperature fixability of the resultant toner may be poor.

Specific examples of usable polyisocyanates include, but are not limited to, aliphatic diisocyanates, alicyclic diisocyanates, aromatic diisocyanates, aromatic aliphatic diisocyanates, isocyanurates, and the above-described polyisocyanates blocked with phenol derivatives, oxime, caprolactam, etc.

Specific examples of usable aliphatic diisocyanates include, but are not limited to, tetramethylene diisocyanate, hexamethylene diisocyanate, 2,6-diisocyanatomethylcaproate, octamethylene diisocyanate, decamethylene diisocyanate, dodecamethylene diisocyanate, tetradecamethylene diisocyanate, trimethylhexane diisocyanate, and tetramethylhexane diisocyanate.

Specific examples of usable alicyclic diisocyanates include, but are not limited to, isophorone diisocyanate and cyclohexylmethane diisocyanate.

Specific examples of usable aromatic diisocyanates include, but are not limited to, tolylene diisocyanate, diisocyanate diphenylmethane, 1,5-naphthylene diisocyanate, 4,4'-diisocyanato diphenyl, 4,4'-diisocyanato-3,3'-dimethyldiphenyl, 4,4'-diisocyanato-3-methyldiphenylmethane, and 4,4'-diisocyanato-diphenyl ether.

Specific examples of usable aromatic aliphatic diisocyanates include, but are not limited to, $\alpha,\alpha,\alpha',\alpha'$-tetramethylxylylene diisocyanate.

Specific examples of usable isocyanurates include, but are not limited to, tris(isocyanatoalkyl)isocyanurate and tris(isocyanatocycloalkyl)isocyanurate.

These compounds can be used alone or in combination.

The equivalent ratio ([NCO]/[MOH]) of isocyanate group [NCO] in the polyisocyanate to hydroxyl group [OH] in the polyester resin having an active hydrogen group is preferably from 1 to 5, more preferably from 1.2 to 4, and most preferably from 1.5 to 3. When the equivalent ratio ([NCO]/[OH]) is too large, low-temperature fixability of the resultant toner may be poor. When the equivalent ratio ([NCO]/[OH]) is too small, hot offset resistance of the resultant toner may be poor.

The polyester prepolymer having an isocyanate group preferably includes the polyisocyanate unit in an amount of from 0.5 to 40% by weight, more preferably from 1 to 30% by weight, and most preferably from 2 to 20% by weight. When the amount is too small, hot offset resistance and storage stability of the resultant toner may be poor. When the amount is too large, low-temperature fixability of the resultant toner may be poor.

The number of isocyanate groups included in one molecule of the polyester prepolymer having an isocyanate group is preferably 1 or more, more preferably from 1.2 to 5, and most preferably from 1.5 to 4. When the number of isocyanate groups is too small, the molecular weight of the resultant urea-modified polyester resin may be small and the resultant toner may have poor hot offset resistance.

The polymer reactive with a compound having an active hydrogen group preferably has a weight average molecular weight of from 1,000 to 30,000, and more preferably from 1,500 to 15,000. When the weight average molecular weight is too small, heat-resistant storage stability of the resultant toner may be poor. When the weight average molecular weight is too large, low-temperature fixability of the resultant toner may be poor.

The weight average molecular weight can be measured by subjecting THF-soluble components thereof to a measurement of the molecular weight distribution by gel permeation chromatography (GPC).

The molecular weight distribution of a resin can be measured as follows. In a GPC instrument, columns are stabilized in a heat chamber at 40° C. Tetrahydrofuran (THF) serving as a solvent is flown therein at a flow speed of 1 ml/min, and 50 to 200 μl of a 0.05 to 0.6% by weight tetrahydrofuran solution of the resin is injected therein. A molecular weight distribution of the resin is determined from a calibration curve created from a couple of monodisperse polystyrene standard samples.

For example, monodisperse polystyrene standard samples each having molecular weights of $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$ are available from Pressure Chemical Co., Tohso Corporation, etc. Preferably, the calibration curve is created from about 10 standard samples. As a detector, RI (refractive index) detectors are preferable.

Preferred embodiments of the binder resin are described below. The binder resin may be a polyester resin, for example, and is preferably an unmodified polyester resin. Unmodified polyester resins provide low-temperature fixability and high gloss.

The unmodified polyester resin may be a polycondensation product of a polyol with a polycarboxylic acid, for example.

From the viewpoint of low-temperature fixability and hot offset resistance, it is preferable that the unmodified polyester resin is partially compatible with an urea-modified polyester resin, in other words, the unmodified polyester resin and the urea-modified polyester resin have similar structures.

The unmodified polyester resin preferably has a weight average molecular weight of from 1,000 to 30,000, and more preferably from 1,500 to 15,000. When the weight average molecular weight is too small, heat-resistant storage stability of the resultant toner may be poor. Accordingly, the unmodified polyester resin preferably includes components having a weight average molecular weight less than 1,000 in an amount of from 8 to 28% by weight. When the weight average molecular weight is too large, low-temperature fixability of the resultant toner may be poor.

The unmodified polyester resin preferably has a glass transition temperature of from 30 to 70° C., more preferably from 35 to 60° C., and most preferably from 35 to 55° C. When the glass transition temperature is too low, heat-resistant storage stability of the resultant toner may be poor. When the glass transition temperature is too high, low-temperature fixability of the resultant toner may be poor.

The unmodified polyester resin preferably has an acid value of from 1.0 to 50.0 mgKOH/g, more preferably from 15.0 to 30.0 mgKOH/g, and most preferably from 15.0 to 25.0 mgKOH/g. In this case, the resultant toner may be negatively chargeable. The greater the acid value, the better the low-temperature fixability. However, when the acid value is too large, the resultant toner may absorb moisture in high-temperature and high-humidity conditions, resulting in poor chargeability of the toner.

The unmodified polyester resin preferably has a hydroxyl value of 5 mgKOH/g or more, more preferably from 10 to 120 mgKOH/g, and most preferably from 20 to 80 mgKOH/g. When the hydroxyl value is too small, it may be difficult that the resultant toner satisfies both heat-resistant storage stability and low-temperature fixability at the same time.

The weight ratio of the polyester prepolymer having an isocyanate group to the unmodified polyester resin is preferably from 5/95 to 25/75, and more preferably from 10/90 to 25/75. When the weight ratio is too small, hot offset resistance of the resultant toner may be poor. When the ratio is too large, low-temperature fixability of the resultant toner may be poor and the resultant image may have low gloss.

The toner of the present invention may include other additives such as release agents, charge controlling agents, particulate resins, particulate inorganic materials, fluidity improving agents, cleanability improving agents, magnetic materials, metal salts, etc.

Specific examples of usable release agents include, but are not limited to, waxes having a carbonyl group, polyolefin waxes, and long-chain hydrocarbons. These materials can be used alone or in combination. Among these materials, waxes having a carbonyl group are preferable.

Specific examples of usable waxes having a carbonyl group include, but are not limited to, esters having multiple residue groups of alkanoic acids (e.g., carnauba wax, montan wax, trimethylolpropane tribehenate, pentaerythritol tetrabehenate, pentaerythritol diacetate dibehenate, glycerin tribehenate, 1,1,8-octadecanediol distearate), esters having multiple residue groups of alkanols (e.g., tristearyl trimellitic acid, distearyl maleic acid), amides having multiple residue groups of alkanoic acids (e.g., dibehenylamide), amides having multiple residue groups of monoamines (e.g., trimellitic acid tristearylamide), and dialkyl ketones (e.g., distearyl ketone). Among these compounds, esters having multiple residue groups of alkanoic acids are preferable.

Specific examples of usable polyolefin waxes include, but are not limited to, polyethylene wax and polypropylene wax.

Specific examples of usable long-chain hydrocarbons include, but are not limited to, paraffin wax and SAZOL wax.

The release agent preferably has a melting point of from 40 to 160° C., more preferably from 50 to 120° C., and most preferably from 60 to 90° C. When the melting point is too low, the release agent may adversely affect heat-resistant storage stability. When the melting point is too high, cold offset may occur in low-temperature fixing.

The release agent preferably has a melt viscosity of from 5 to 1,000 cps, more preferably from 10 to 100 cps, at a temperature 20° C. higher than the melting point of the release agent. When the melt viscosity is too small, separability of the resultant toner may be poor. When the melt viscosity is too large, hot offset resistance and low-temperature fixability may be poor.

The toner preferably includes the release agent in an amount of 40% by weight or less, more preferably from 3 to 30% by weight. When the amount is too large, fluidity of the resultant toner may be poor.

Suitable charge controlling agents are preferably colorless or white so as not to change the color tone.

Specific examples of usable charge controlling agents include, but are not limited to, triphenylmethane dyes, chelate compounds of molybdic acid, Rhodamine dyes, alkoxyamines, quaternary ammonium salts including fluorine-modified quaternary ammonium salts, alkylamides, phosphor and compounds including phosphor, tungsten and compounds including tungsten, fluorine-containing activators, metal salts of salicylic acid, and metal salts of salicylic acid derivatives. These charge controlling agents can be used alone or in combination.

Specific examples of commercially available charge controlling agents include, but are not limited to, BONTRON® P-51 (quaternary ammonium salt), BONTRON® BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; and quinacridone, and azo pigments, and polymers having a functional group such as a sulfonate group, a carboxyl group, and a quaternary ammonium group.

The charge controlling agent may be dissolved or dispersed in the toner components liquid directly, or in the form of a master-batch that is prepared by melt-kneading the charge controlling agent with a resin. Alternatively, the charge controlling agent may be fixed on the surface of toner particles.

The content of the charge controlling agent in the toner is determined depending on the species of the binder resin used, the presence or absence of additives, and toner manufacturing method (such as dispersion method) used, and is not particularly limited. However, the content of the charge controlling agent is preferably from 0.1 to 10% by weight, and preferably from 0.2 to 5% weight, based on the total weight of the binder resin included in the toner. When the content is too low, chargeability may not be controllable. When the content is too high, the toner may have an excessively large charge quantity. Such a toner may be electrostatically attracted to a developing roller, which results in deterioration of fluidity of the toner and the resultant image density.

Suitable particulate resins may be resins capable of forming an aqueous dispersion thereof. Specific examples of suitable resins for the particulate resin include, but are not limited to, thermoplastic and thermosetting resins such as vinyl resins, polyurethane resins, epoxy resins, polyester resins, polyamide resins, polyimide resins, silicone reins, phenol resins, melamine resins, urea resins, aniline resins, ionomer resins, and polycarbonate resins. Among these resins, vinyl resins, polyurethane resins, epoxy resins, and polyester resins are preferable because aqueous dispersions containing fine spherical particles thereof are easily obtained. These resins can be used alone or in combination.

Specific examples of the vinyl resins include homopolymers and polymers of vinyl monomers, such as styrene-(meth)acrylate copolymers, styrene-butadiene copolymers, (meth)acrylic acid-acrylate copolymers, styrene-acrylonitrile copolymers, styrene-maleic anhydride copolymers, and styrene-(meth)acrylic acid copolymers.

Additionally, copolymers obtained by polymerizing monomers having multiple unsaturated groups can be also used.

Specific examples of usable monomers having multiple unsaturated groups include, but are not limited to, a sodium salt of sulfate of ethylene oxide adduct of methacrylic acid (ELEMINOL RS-30 from Sanyo Chemical Industries, Ltd.), divinylbenzene, and 1,6-hexanediol acrylate.

The particulate resin is preferably prepared as an aqueous dispersion thereof. Specific preferred methods for forming an aqueous dispersion of the particulate resin include the following methods (1) to (8), for example.

(1) Subjecting a vinyl monomer to any one of suspension polymerization, emulsion polymerization, seed polymerization, and dispersion polymerization, so that an aqueous dispersion of a particulate resin is directly prepared.

(2) Dispersing a precursor (such as a monomer and an oligomer) of a polyaddition or polycondensation resin (such as a polyester resin, a polyurethane resin, and an epoxy resin) or a solution thereof in an aqueous medium in the presence of a suitable dispersing agent, followed by heating or adding a curing agent, so that an aqueous dispersion of a particulate resin is prepared.

(3) Dissolving a suitable emulsifying agent in a precursor (such as a monomer and an oligomer) of a polyaddition or polycondensation resin (such as a polyester resin, a polyurethane resin, and an epoxy resin) or a solution thereof, and subsequently adding water thereto, so that an aqueous dispersion of a particulate resin is prepared by phase-inversion emulsification.

(4) Pulverizing a resin using a mechanical rotational type pulverizer or a jet type pulverizer, classifying the pulverized particles to prepare a particulate resin, and dispersing the particulate resin in an aqueous medium in the presence of a suitable dispersing agent, so that an aqueous dispersion of the particulate resin is prepared.

(5) Spraying a resin solution into the air to prepare a particulate resin, and dispersing the particulate resin in an aqueous medium in the presence of a suitable dispersing agent, so that an aqueous dispersion of the particulate resin is prepared.

(6) Adding a poor solvent to a resin solution or cooling a resin solution in which a resin is dissolved in a solvent with application of heat, to precipitate a particulate resin, and dispersing the particulate resin in an aqueous medium in the presence of a suitable dispersing agent, so that an aqueous dispersion of the particulate resin is prepared.

(7) Dispersing a resin solution in an aqueous medium in the presence of a suitable dispersing agent and removing the solvent by application of heat, reduction of pressure, or the like, so that an aqueous dispersion of a particulate resin is prepared.

(8) Dissolving a suitable emulsifying agent in a resin solution and subsequently adding water thereto, so that an aqueous dispersion of a particulate resin is prepared by phase-inversion emulsification.

Particulate inorganic materials may be externally added to the toner to improve fluidity, developability, and chargeability. Specific examples of usable particulate inorganic materials include, but are not limited to, silica, alumina, titanium oxide, barium titanate, magnesium titanate, calcium titanate, strontium titanate, zinc oxide, tin oxide, quartz sand, clay, mica, sand-lime, diatomearth, chromiumoxide, ceriumoxide, red ironoxide, antimonytrioxide, magnesiumoxide, zirconium oxide, barium sulfate, barium carbonate, calcium carbonate, silicon carbide, and silicon nitride. These inorganic materials can be used alone or in combination.

The particulate inorganic material preferably has a primary particle diameter of from 5 nm to 2 μm. The particulate inorganic material preferably has a BET specific surface area of from 20 to 500 $m^2/g$.

The toner preferably includes the particulate inorganic material in an amount of from 0.01 to 5.0% by weight, based on total weight of the toner.

The particulate inorganic materials may be treated with fluidity improving agents. In this case, hydrophobicity of the toner may increase, and deterioration of fluidity and chargeability of the toner is prevented even in high humidity conditions.

Specific examples of usable fluidity improving agents include, but are not limited to, silane-coupling agents, silylation agents, silane-coupling agents having a fluorinated alkyl group, silicone oils, and modified silicone oils.

Cleanability improving agents may be added to the toner so that residual toner particles remaining on the surface of a photoreceptor or a primary transfer medium without being transferred onto a recording radium are easily removed.

Specific examples of usable cleanability improving agents include, but are not limited to, metal salts of fatty acids such as zinc stearate and calcium stearate; and particulate polymers such as polymethyl methacrylate and polystyrene, which are produced by soap-free emulsion polymerization methods. Particulate polymers preferably have a relatively narrow particle diameter distribution and a volume average particle diameter of from 0.01 μm to 1 μm.

Specific examples of usable magnetic materials include, but are not limited to, iron powders, magnetites, and ferrites. In view of color tone of the resultant toner, whitish materials are preferable.

The toner of the present invention is produced by suspending an oily liquid comprising a binder resin and a colorant in an aqueous medium.

An exemplary method of producing the toner is described below. This method includes the processes of preparing an aqueous medium, preparing a toner components liquid, emulsifying or dispersing the toner components liquid in the aqueous medium, producing an adhesive base material, removing solvents, preparing a polymer reactive with active hydrogen groups, and preparing a compound having an active hydrogen group.

The aqueous medium is prepared by dispersing a particulate resin in an aqueous medium. The aqueous medium preferably includes the particulate resin in an amount of from 0.5 to 10% by weight.

The toner components liquid is prepared by dissolving or dispersing toner components in a solvent. Toner components include a compound having an active hydrogen group, a polymer reactive with active hydrogen groups, a colorant, a release agent, a charge controlling agent, an unmodified polyester resin, etc.

Toner components other than the polymer reactive with active hydrogen groups may be added to the aqueous medium at the time the particulate resin is dispersed in the aqueous medium, or at the time the toner components liquid is added to the aqueous medium.

The toner components liquid is emulsified or dispersed in the aqueous medium. At the same time, the compound having an active hydrogen group and the polymer reactive with active hydrogen groups are subjected to an elongation reaction and/or a cross-linking reaction so as to form an adhesive base material.

The adhesive base material may be an urea-modified polyester resin, for example. In this case, the polymer reactive active hydrogen groups may be a polyester prepolymer having an isocyanate group, and the compound having an active hydrogen group may be an amine, for example.

The adhesive base material may be formed as follows, for example.

(1) Emulsifying or dispersing a liquid containing the polymer reactive with active hydrogen groups along with the compound having an active hydrogen group in the aqueous medium, and subjecting the polymer reactive with active hydrogen groups and the compound having an active hydrogen group to an elongation reaction and/or a cross-linking reaction in the aqueous medium.

(2) Emulsifying or dispersing a liquid containing toner components in the aqueous medium to which the compound having an active hydrogen group is previously added, and subjecting the polymer reactive with active hydrogen groups and the compound having an active hydrogen group to an elongation reaction and/or a cross-linking reaction in the aqueous medium.

(3) Emulsifying or dispersing a liquid containing toner components in the aqueous medium, followed by adding the compound having an active hydrogen group therein, so that the polymer reactive with active hydrogen groups and the compound having an active hydrogen group are subjected to an elongation reaction and/or a cross-linking reaction from interfaces between the droplets and the aqueous medium. In this case, the adhesive base material (e.g., a urea-modified polyester resin) may be preferentially formed on the surface of the resultant toner, forming a concentration gradient of the adhesive base material in the toner.

Reaction conditions for producing the adhesive base material depend on the kinds of the polymer reactive active hydrogen groups and the compound having an active hydrogen group. The reaction time is preferably 10 minutes to 40 hours, and more preferably from 2 to 24 hours. The reaction temperature is preferably 150° C. or less, and more preferably from 40 to 98° C.

It is preferable that the toner components liquid including a polymer reactive with active hydrogen groups, a colorant, a colorant dispersing agent, a release agent, a charge controlling agent, a unmodified polyester resin, etc., is dispersed in the aqueous medium by application of shearing force.

The shearing force may be applied by a low-speed shearing-type disperser, a high-speed shearing-type disperser, a friction-type disperser, a high-pressure jet-type disperser, or an ultrasonic disperser, for example. Among these dispersers, high-speed shearing-type dispersers are preferable because dispersoids can be controlled to have particle diameters of from 2 to 20 μm.

The revolution number, dispersing time, and dispersing temperature of the high-speed shearing-type disperser are not limited. However, the revolution number is preferably from 1,000 to 30,000 rpm, more preferably from 5,000 to 20,000 rpm. The dispersing time is preferably from 0.1 to 5 minutes, when the high-speed shearing-type disperser is batch-type. The dispersing temperature is preferably 150° C. or less, more preferably from 40 to 98° C., under pressure. Generally, the higher the dispersing temperature, the easier the dispersing.

A usable amount of the aqueous medium at the emulsification or dispersion of the toner components liquid is preferably from 50 to 2,000 parts by weight, and more preferably from 100 to 1,000 parts by weight, based on 100 parts by weight of toner components. When the amount of the aqueous medium is too small, toner components may not be dispersed finely and the resultant particles may not have a desired size. When the amount of the aqueous medium is too large, toner production cost may increase.

The aqueous medium may further include a dispersing agent for the purpose that reliable liquid droplets are formed and the resultant particles have a desired size and a narrow size distribution.

Specific examples of usable dispersing agents include, but are not limited to, surfactants, inorganic dispersing agents having poor water solubility, and polymeric protection colloid. Among these dispersing agents, surfactants are preferable. These dispersing agents can be used alone or in combination.

Specific examples of usable surfactants include, but are not limited to, anionic surfactants, cationic surfactants, nonionic surfactants, and amphoteric surfactants.

The anionic surfactants may be, for example, alkylbenzene sulfonates, α-olefin sulfonates, and phosphates. In particular, surfactants having a fluoroalkyl group are preferable.

Specific preferred examples of anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11)oxy]-1-alkyl(C3-C4)sulfonic acid sodium, 3-[ω-fluoroalkanoyl(C6-C8)-N-ethylamino]-1-propane sulfonic acid sodium, fluoroalkyl(C11-C20)carboxylic acids and metal salts thereof, perfluoroalkyl(C7-C13)carboxylic acids and metal salts thereof, perfluoroalkyl(C4-C12)sulfonic acids and metal salts thereof, perfluorooctane sulfonic acid dimethanol amide, N-propyl-N-(2-hydroxyethyl)perfluorooctane sulfonamide, perfluoroalkyl(C6-C10) sulfonamide propyl trimethyl ammonium salts, perfluoroalkyl(C6-C10)-N-ethyl sulfonyl glycine salts, and monoperfluoroalkyl(C6-C16)ethyl phosphates.

Specific examples of usable commercially available anionic surfactants having a fluoroalkyl group include, but are not limited to, SARFRON® S-111, S-112 and S-113 (manufactured by Asahi Glass Co., Ltd.); FLUORAD® FC-93, FC-95, FC-98 and FC-129 (manufactured by Sumitomo 3M Ltd.); UNIDYNE® DS-101 and DS-102 (manufactured by Daikin Industries, Ltd.); MEGAFACE® F-110, F-120, F-113, F-191, F-812 and F-833 (manufactured by Dainippon Ink and Chemicals, Inc.); ECTOP® EF-102, 103, 104, 105, 112, 123A, 123B, 306A, 501, 201 and 204 (manufactured by Tochem Products Co., Ltd.); and FUTARGENT® F-100 and F-150 (manufactured by Neos).

Specific preferred examples of usable cationic surfactants include, but are not limited to, amine salt surfactants such as alkylamine salts, amino alcohol fatty acid derivatives, polyamine fatty acid derivatives, and imidazolines; and quaternary ammonium salt surfactants such as alkyl trimethyl ammonium salts, dialkyl dimethyl ammonium salts, alkyl dimethyl benzyl ammonium salts, pyridinium salts, alkyl isoquinolinium salts, and benzethonium chlorides. Among these cationic surfactants, aliphatic primary, secondary, and tertiary amine acids having a fluoroalkyl group, aliphatic tertiary ammonium salts such as perfluoroalkyl(C6-C10)sulfonamide propyl trimethyl ammonium salts, benzalkonium salts, benzethonium chlorides, pyridinium salts, and imidazolinium salts are preferable.

Specific examples of usable commercially available cationic surfactants include, but are not limited to, SARFRON® S-121 (manufactured by Asahi Glass Co., Ltd.); FLUORAD® FC-135 (manufactured by Sumitomo 3M Ltd.); UNIDYNE® DS-202 (manufactured by Daikin Industries, Ltd.); MEGAFACE® F-150 and F-824 (manufactured by Dainippon Ink and Chemicals, Inc.); ECTOP® EF-132 (manufactured by Tohchem Products Co., Ltd.); and FUTARGENT® F-300 (manufactured by Neos).

Specific preferred examples of usable nonionic surfactants include, but are not limited to, fatty acid amide derivatives and polyvalent alcohol derivatives.

Specific preferred examples of usable amphoteric surfactants include, but are not limited to, alanine, dodecyl di(aminoethyl)glycine, di(octyl aminoethyl)glycine, and N-alkyl-N,N-dimethyl ammonium betaine.

Specific examples of usable inorganic dispersing agents having poor water solubility include, but are not limited to, tricalcium phosphate, calcium carbonate, titanium oxide, colloidal silica, and hydroxyapatite.

Specific examples of usable polymeric protection colloids include, but are not limited to, homopolymers and copolymers obtained from monomers having carboxyl group, alkyl (meth)acrylates having hydroxyl group, vinyl ethers, vinyl carboxylates, amide monomers, acid chloride monomers, and/or monomers containing nitrogen or a heterocyclic ring containing nitrogen; polyoxyethylene-based resins; and celluloses. The above homopolymers and copolymers may include a unit derived from vinyl alcohols.

Specific examples of usable monomers having carboxyl group include, but are not limited to, acrylic acid, methacrylic acid, α-cyanoacrylic acid, α-cyanomethacrylic acid, itaconic acid, crotonic acid, fumaric acid, maleic acid, and maleic anhydride.

Specific examples of usable alkyl(meth)acrylates having hydroxyl group include, but are not limited to, β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, and glycerin monomethacrylate.

Specific examples of usable vinyl ethers include, but are not limited to, vinyl methyl ether, vinyl ethyl ether, and vinyl propyl ether.

Specific examples of usable vinyl carboxylates include, but are not limited to, vinyl acetate, vinyl propionate, and vinyl butyrate.

Specific examples of usable amide monomers include, but are not limited to, acrylamide, methacrylamide, diacetone acrylamide, N-methylol acrylamide, and N-methylol methacrylamide.

Specific examples of usable acid chloride monomers include, but are not limited to, acrylic acid chloride and methacrylic acid chloride.

Specific examples of usable monomers containing nitrogen or a heterocyclic ring containing nitrogen include, but are not limited to, vinyl pyridine, vinyl pyrrolidone, vinyl imidazole, and ethylene imine.

Specific examples of usable polyoxyethylene-based resins include, but are not limited to, polyoxyethylene, polyoxypropylene, polyoxyethylene alkyl amine, polyoxypropylene alkyl amine, polyoxyethylene alkyl amide, polyoxypropylene alkyl amide, polyoxyethylene nonylphenyl ether, polyoxyethylene laurylphenyl ether, polyoxyethylene phenyl stearate, and polyoxyethylene phenyl pelargonate.

Specific examples of usable celluloses include, but are not limited to, methyl cellulose, hydroxyethyl cellulose, and hydroxypropyl cellulose.

Usable dispersing agents may be soluble in acids and bases. For example, calcium phosphate is soluble in acid such as hydrochloric acid. Alternatively, calcium phosphate may be decomposed by enzymes.

The elongation reaction and/or cross-linking reaction for producing an adhesive base material may be performed using a catalyst. Specific examples of usable catalysts include, but are not limited to, dibutyl tin laurate and dioctyl tin laurate.

The organic solvent may be removed from the dispersion or emulsion by, for example, gradually heating the dispersion or emulsion to completely evaporate the organic solvent from the droplets, or spraying the dispersion or emulsion into dry atmosphere to completely remove the organic solvent from the droplets.

Toner particles are generally formed upon removal of the organic solvent, followed by washing and drying, and optionally classification by size. The dispersion or emulsion may be subjected to a wet classification method such as cyclone, decantation, or centrifugal separation, to remove ultrafine particles. Alternatively, dried toner particles may be subjected to a dry classification method.

The toner particles thus prepared may be mixed with particulate materials such as colorants, release agents, charge controlling agents, etc., optionally upon application of mechanical impact thereto to fix the particulate materials on the toner particles.

Specific examples of such mechanical impact application methods include a method in which a mixture is mixed with a highly rotated blade and a method in which a mixture is put into an air jet to collide the particles against each other or a collision plate.

Specific examples of such mechanical impact applicators include, but are not limited to, ONG MILL (from Hosokawa Micron Co., Ltd.), modified I TYPE MILL in which the pressure of air used for pulverizing is reduced (from Nippon Pneumatic Mfg. Co., Ltd.), HYBRIDIZATION SYSTEM (from Nara Machine Co., Ltd.), KRYPTON SYSTEM (from Kawasaki Heavy Industries, Ltd.), and automatic mortars.

The toner of the present invention is preferably used for electrophotographic image forming.

The toner of the present invention preferably includes toner particles having a circularity of 0.950 or less in an amount of from 20 to 80% by number based on the total number of toner particles. When the amount of toner particles having a circularity of 0.950 or less is too large, transferability of the toner may be poor and toner scattering may occur. When the amount of toner particles having a circularity of 0.950 or less is too small, residual toner particles on photoreceptors may not be sufficiently removed.

The shape of a toner particle is preferably determined by an optical detection method in which a suspension liquid containing toner particles is passed an image detector located on a flat plate and images of the toner particles are optically detected by a CCD camera to be analyzed.

The circularity of a particle is determined by the following equation:

$$\text{Circularity}=Cs/Cp$$

wherein Cp represents the length of the circumference of a projected image of a particle and Cs represents the length of the circumference of a circle having the same area as the projected image of the particle.

When the toner includes toner particles having a circularity of 0.950 or less in an amount of from 20 to 80% by number based on the total number of toner particles, high definition images with an appropriate density are reliably produced.

The circularity of toner can be determined using a flow-type particle image analyzer FPIA-2100 (from Sysmex Corp.)

The toner of the present invention preferably has a volume average particle diameter of from 3 to 8 μm, and more preferably from 4 to 7 μm. When the volume average particle diameter is too small, the toner may gradually fuse onto the surface of carrier with time and degrade charging ability of the carrier, when the toner is used for two-component developers. Alternatively, the toner may form undesired thin films thereof on a developing roller or fuse onto a toner layer forming blade, when the toner is used for one-component developers. By comparison, when the volume average particle diameter is too large, high definition and high quality images may not be produced and the average particle diameter of toner particles in a developer may vary largely after repeated consumption and replenishment of toner particles.

Additionally, the ratio (Dv/Dn) of a volume average particle diameter (Dv) to a number average particle diameter (Dn) of the toner is preferably from 1.00 to 1.25, and more preferably from 1.05 to 1.25, and most preferably 1.20 or less. In this case, when used for two-component developers, the average particle diameter of toner particles in a developer may not vary largely even after repeated consumption and replenishment of toner particles for an extended period of time, and the toner provides reliable developability even after a long-term agitation in developing devices. When used for one-component developers, the average particle diameter of toner particles in a developer may not vary largely even after repeated consumption and replenishment of toner particles, and the toner may not fuse on developing rollers and toner layer forming blades.

When the ratio (Dv/Dn) is too large, it is difficult to produce high definition and high quality images. In addition, the average particle diameter of toner particles in a developer may vary largely after repeated consumption and replenishment of toner particles.

The toner of the present invention preferably includes toner particles having a particle diameter of 2 μm or less in an amount of from 1 to 20% by number based on the total number of toner particles from the viewpoint of temporal stability. When the amount is too large, the toner particles having a particle diameter of 2 μm or less may contaminate a developing roller or form aggregates in a developing device because of having poor fluidity and high adhesion force. Such small toner particles also have poor transferability. It is difficult to reduce the amount of toner particles having a particle diameter of 2 μm or less to less than 1% from the viewpoint of productivity.

The volume average particle diameter (Dv) and number average particle diameter (Dn) of toners can be measured by a particle size measuring instrument MULTISIZER III (from Beckman Coulter K. K.).

A typical measuring method is as follows. First, 0.1 to 5 ml of a surfactant (e.g., an alkylbenzene sulfonate) is added to 100 to 150 ml of an electrolyte solution (e.g., a 1% by weight sodium chloride aqueous solution). Next, 2 to 20 mg of a toner is added thereto to prepare a toner suspension. The toner suspension is dispersed using an ultrasonic dispersing machine for about 1 to 3 minutes. The toner suspension is then subjected to a measurement of distributions of the volume and number of toner particles using the above-described instrument equipped with an aperture of 100 μm. The volume and number average particle diameters are calculated from the distributions measured above.

The toner of the present invention preferably has a penetration of 15 mm or more, more preferably from 20 to 30 mm. When the penetration is too small, heat-resistant storage stability of the toner may be poor.

The penetration can be measured as according to a penetration test disclosed in JIS K2235-1991. First, a 50-ml glass container is filled with a toner and left for 20 hours in a constant-temperature chamber. The toner is then cooled to room temperature and subjected to the penetration test. The greater the penetration, the better the heat-resistant storage stability.

The toner of the present invention preferably has both low-temperature fixability and hot offset resistance. In particular, the minimum fixable temperature is preferably 140° C. or less and the maximum fixable temperature is preferably 200° C. or more.

The minimum fixable temperature is a temperature below which the residual rate of image density is 70% or more when an image is rubbed with a pad. The maximum fixable temperature is a temperature above which offset problem occurs.

Thermal properties of toners may be evaluated by softening temperature, flow stating temperature, and ½ method softening temperature. These can be measured by a capillary rheometer CFT-500 (from Shimadzu Corporation).

The toner of the present invention preferably has a softening temperature of 30° C. or more, and more preferably from 50 to 90° C. When the softening temperature is too low, heat-resistant storage stability may be poor.

The toner of the present invention preferably has a flow starting temperature of 60° C. or more, and more preferably from 80 to 120° C. When the flow starting temperature is too low, at least one of heat-resistant storage stability and hot offset resistance may be poor.

The toner of the present invention preferably has a ½ method softening temperature of 90° C. or more, and more preferably from 100 to 170° C. When the ½ method softening temperature is too low, hot offset resistance may be poor.

The toner of the present invention preferably has a glass transition temperature of from 40 to 70° C., and more preferably from 45 to 65° C. When the glass transition temperature is too low, heat-resistant storage stability may be poor. When the glass transition temperature is too high, low-temperature fixability may be poor. The glass transition temperature can be measured using a differential scanning calorimeter DSC-60 (from Shimadzu Corporation).

The toner of the present invention is preferably capable of producing a specific image with an image density of 1.40 or more, more preferably 1.45 or more, and most preferably 1.50 or more. When the toner is not capable of producing the specific image with an image density of 1.40 or more, high quality images may not be produced at all. The specific image is a solid image including 0.35±0.02 mg/cm$^2$ of a toner formed on a copy paper TYPE 6200 (from Ricoh Co., Ltd.). This solid image is formed by a tandem full-color image forming apparatus (IMAGIO NEO 450 from Ricoh Co., Ltd.) while setting the surface temperature of a fixing roller to 160±2° C. Five randomly-selected portions of the solid image are subjected to a measurement of image density using a spectrodensitometer 938 (from X-Rite). The measured values are averaged.

The developer of the present invention includes the toner of the present invention, and optionally includes other components such as a carrier. The developer of the present invention reliably produces high quality images.

The developer may be both a one-component developer that includes the toner and no carrier and a two-component developer that includes the toner and a carrier.

With regard to the one-component developer of the present invention, the average particle diameter of toner particles in the developer may not vary largely even after repeated consumption and replenishment of toner particles, and the toner may not fuse on developing rollers and toner layer forming blades. Therefore, the developer provides reliable developability even after a long-term agitation in developing devices.

With regard to the two-component developer of the present invention, the average particle diameter of toner particles in the developer may not vary largely even after repeated consumption and replenishment of toner particles for an extended period of time. Therefore, the developer provides reliable developability even after a long-term agitation in developing devices.

A suitable carrier includes a core material and a resin layer that covers the core material.

The core material may be manganese-strontium materials and manganese-magnesium materials having a magnetization of from 50 to 90 emu/g, for example.

In addition, the core material may be a high-magnetization material such as iron powders having a magnetization of 100 emu/g or more or magnetites having a magnetization of from 75 to 120 emu/g. In this case, the resultant image density may be high.

Moreover, the core material may be a low-magnetization material such as copper-tin materials having a magnetization of from 30 to 80 emu/g. In this case, developer brushes that are formed on a developing roller may softly contact a photoreceptor with making a little impact thereon, resulting in high quality images.

These core materials can be used alone or in combination.

The core material preferably has a volume average particle diameter of from 10 to 150 μm, and more preferably from 40 to 100 μm. When the volume average particle diameter is too small, the resultant carrier may include a very large amount of ultrafine particles. As a result, the magnetization per particle may decrease and carrier scattering may occur. When the volume average particle diameter is too large, the specific surface area of the resultant carrier may decrease and toner scattering may occur. In addition, solid images may not be reproduced faithfully.

Specific examples of usable resins for the resin layer include, but are not limited to, amino resins, polyvinyl resins, polystyrene resins, halogenated polyolefin, polyester resins, polycarbonate resins, polyethylene, polyvinyl fluoride, polyvinylidene fluoride, polytrifluoroethylene, polyhexafluoropropylene, copolymers of vinylidene fluoride and acrylic monomers, copolymers of vinylidene fluoride and vinyl fluoride, fluoroterpolymers (such as copolymers of tetrafluoroethylene, vinylidene fluoride, and monomers having no fluoro group), and silicone resins. These resins can be used alone or in combination.

Specific examples of usable amino resins include, but are not limited to, urea-formaldehyde resins, melamine resins, benzoguanamine resins, urea resins, polyamide resins, and epoxy resins.

Specific examples of usable polyvinyl resins include, but are not limited to, acrylic resins, polymethyl methacrylate, polyacrylonitrile, polyvinyl acetate, polyvinyl alcohol, and polyvinyl butyral.

Specific examples of usable polystyrene resins include, but are not limited to, polystyrene and styrene-acrylic copolymers.

Specific examples of usable halogenated polyolefin include, but are not limited to, polyvinyl chloride.

Specific examples of usable polyester resins include, but are not limited to, polyethylene terephthalate and polybutylene terephthalate.

The resin layer may include a conductive powder, if needed. Specific examples of usable conductive powders include, but are not limited to, powders of metals, carbon black, titanium oxide, and tin oxide. The conductive powder preferably has an average particle diameter of 1 μm or less. When the average particle diameter is too large, it is difficult to control electric resistance of the resin layer.

The resin layer may be formed by applying an application liquid on the surface of the core material, followed by drying and baking. The application liquid includes a solvent in which a resin such as a silicone resin is dissolved.

The application liquid may be applied by a dip application method, a spraying method, a brush application method, etc. Specific examples of usable solvents for the application liquid include, but are not limited to, toluene, xylene, methyl ethyl ketone, methyl isobutyl ketone, and butyl cellosolve acetate. The baking may be performed by either external heating methods or internal heating methods such as methods using a fixed electric furnace, a fluid electric furnace, a rotary electric furnace, or a burner furnace, and methods using microwave.

The carrier preferably includes the resin layer in an amount of from 0.01 to 5.0% by weight. When the amount is too small, the resin layer may not be evenly formed on the surface of the core material. When the amount is too large, the carrier particles may coalesce with each other because the resin layer is too thick.

The two-component developer preferably includes the carrier in an amount of from 90 to 98% by weight, and more preferably from 93 to 97% by weight.

The developer of the present invention may be preferably used for electrophotographic methods such as magnetic one-component developing methods, non-magnetic one-component developing methods, and two-component developing methods.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Measurement of Weight Average Molecular Weight of Resins

In the following examples, the weight average molecular weight of resins is measured under the following conditions.

Measuring Instrument: GPC-8220GPC (from Tosoh Corporation)

Columns: TSK gel Super HZM-H 15 cm×3 (from Tosoh Corporation)

Temperature: 40° C.

Solvent: THF

Flow rate: 0.35 ml/min

Sample injection: 100 μl of 0.15% sample

To prepare a sample, a resin is dissolved in tetrahydrofuran (THF including a stabilizer, from Wako Pure Chemical Industries, Ltd.) so that the concentration becomes 0.15%. The THF solution is filtered with a filter having openings of 0.2 μm. The resulting filtered liquid is treated as a sample for the measurement, and 100 μl of the sample are injected into the measuring instrument. The molecular weight of the sample is determined from a count number and a logarithm number of a calibration curve created from several monodisperse polystyrene standard samples SHOWDEX STANDARD No. S-7300, S-210, S-390, S-875, S-1980, S-10.9, S-629, S-3.0, and S-0.580 (from Showa Denko K. K.) and toluene. The detector is a refractive index detector.

Measurement of Volume Average Particle Diameter of Toners

In the following examples, the volume average particle diameters (Dv) of toners are measured using a particle size measuring instrument MULTISIZER III (from Beckman Coulter K. K.) with an aperture diameter of 100 μm and analysis software program Beckman Coulter Multisizer 3 Version 3.51.

First, 0.5 ml of a 10% surfactant (an alkylbenzene sulfonate NEOGEN SC-A from Daiichi Kogyo Seiyaku Co., Ltd.) are contained in a 100-ml glass beaker, and 0.5 g of a toner are further added thereto. The mixture is stirred with a micro spatula and 80 ml of ion-exchange water are added thereto. The resulting toner dispersion is dispersed using an ultrasonic dispersing machine (W-113MK-II from Honda Electronics) for 10 minutes.

The toner dispersion is then subjected to a measurement using the measuring instrument MULTISIZER III and a measuring solution ISOTON-III (from Beckman Coulter K. K.) while the measuring instrument indicates that the toner dispersion has a concentration of 8±2%. It is important to keep the toner dispersion to have a concentration of 8±2% so as not to cause measurement error.

Synthesis of Quinacridone Pigment A Having the Formula (1)

First, 15 g of dimethylquinacridone, 1.6 g of paraformaldehyde, and 8.4 g of 4-aminophthalimide are added to 200 g of concentrated sulfuric acid (98%), and the mixture liquid is subjected to a reaction for 5 hours at 85° C.

The mixture liquid is then poured into 1 liter of ice water, followed by filtration and water washing. Thus, 11.8 g of (4-aminophthalimidemethyl)-dimethylquinacridone, to which one 4-aminophthalimidemethyl group is introduced, are prepared.

Next, 10 parts of the above-prepared (4-aminophthalimidemethyl)-dimethylquinacridone are dispersed in 100 parts of water and 3.6 parts of cyanuric chloride, which may react with one amino group, are further added thereto. The mixture is subjected to a reaction for 1 hour at 30° C.

Further, 3.4 parts of orthanilic acid are added, and the mixture is subjected to a reaction for 2 hours at 80° C. so that the remaining one chloride (Cl) is hydrolyzed. Thus, 15.2 parts of a quinacridone pigment A are prepared.

Synthesis of Unmodified Polyester Resin A

A reaction vessel equipped with a condenser, a stirrer, and a nitrogen inlet pipe is charged with 229 parts of ethylene oxide 2 mol adduct of bisphenol A, 529 parts of propylene oxide 3 mol adduct of bisphenol A, 208 parts of terephthalic acid, 46 parts of adipic acid, and 2 parts of dibutyltin oxide. The mixture is subjected to a reaction for 8 hours at 230° C. under normal pressure.

The mixture is further subjected to a reaction for 5 hours under reduced pressures of from 10 to 15 mmHg. Subsequently, 44 parts of trimellitic anhydride are further added, and the mixture is subjected to a reaction for 2 hours at 180° C. under normal pressure. Thus, an unmodified polyester resin A is prepared.

The unmodified polyester resin A has a number average molecular weight of 2,500, a weight average molecular weight of 6,700, and a glass transition temperature of 44° C.

Toner Example 1

Preparation of Pigment Dispersion

A vessel equipped with a stirrer is charged with 250 parts of the unmodified polyester resin A and 1,625 parts of ethyl acetate. The mixture is agitated so that the unmodified polyester resin A is dissolved in the ethyl acetate.

Next, 250 parts of the quinacridone pigment A are added to the vessel and the mixture is agitated for 1 hour.

The resulting pigment mixture is subjected to a dispersion treatment using a bead mill (ULTRAVISCOMILL (trademark) from Aimex Co., Ltd.) under the following conditions.

Liquid feeding speed: 1 kg/hour
Peripheral speed of disc: 8 m/sec
Dispersion media: zirconia beads with a diameter of 0.3 mm
Filling factor of beads: 80% by volume
Repeat number of dispersing operation: 5 times (5 passes)

Thus, a pigment dispersion A is prepared.

(Preparation of Wax Dispersion)

A reaction vessel equipped with a stirrer and a thermometer is charged with 378 parts of the unmodified polyester resin A, 110 parts of a carnauba wax, 22 parts of a metal complex of salicylic acid (E-84 from Orient Chemical Industries Co., Ltd.), and 947 parts of ethyl acetate. The mixture is heated to 80° C. while being agitated. The mixture is kept at 80° C. for 5 hours and cooled to 30° C. over a period of 1 hour. Thus, a raw material liquid is prepared.

The raw material liquid is subjected to a dispersion treatment using a bead mill (ULTRAVISCOMILL (trademark) from Aimex Co., Ltd.) under the following conditions so that the carnauba wax is dispersed.

Liquid feeding speed: 1 kg/hour
Peripheral speed of disc: 6 m/sec
Dispersion media: zirconia beads with a diameter of 0.5 mm
Filling factor of beads: 80% by volume
Repeat number of dispersing operation: 3 times (5 passes)

Thus, a wax dispersion is prepared.

(Preparation of Toner Components Dispersion)

Next, the above-prepared wax dispersion and 290 parts of the pigment dispersion A are added to 1,324 parts of a 65% ethyl acetate solution of the unmodified polyester resin A. The mixture is agitated for 30 minutes using T. K. HOMOMIXER (from PRIMIX Corporation). Thus, a toner components dispersion is prepared.

(Preparation of Intermediate Polyester Resin)

A reaction vessel equipped with a condenser, a stirrer, and a nitrogen inlet pipe is charged with 682 parts of ethylene oxide 2 mol adduct of bisphenol A, 81 parts of propylene oxide 2 mol adduct of bisphenol A, 283 parts of terephthalic acid, 22 parts of trimellitic anhydride, and 2 parts of dibutyltin oxide. The mixture is subjected to a reaction for 8 hours at 230° C. under normal pressure. The mixture is further subjected to a reaction for 5 hours under reduced pressures of from 10 to 15 mmHg. Thus, an intermediate polyester resin is prepared.

The intermediate polyester resin has a number average molecular weight of 2,100, a weight average molecular weight of 9,500, a glass transition temperature of 55° C., an acid value of 0.5 mgKOH/g, and a hydroxyl value of 51 mgKOH/g.

(Preparation of Prepolymer)

A reaction vessel equipped with a condenser, a stirrer, and a nitrogen inlet pipe is charged with 410 parts of the intermediate polyester resin, 89 parts of isophorone diisocyanate, and 500 parts of ethyl acetate. The mixture is subjected to a reaction for 5 hours at 100° C. Thus, a prepolymer is prepared. The prepolymer includes free isocyanates in an amount of 1.53%.

(Preparation of Ketimine Compound)

A reaction vessel equipped with a stirrer and a thermometer is charged with 170 parts of isophoronediamine and 75 parts of methyl ethyl ketone. The mixture is subjected to a reaction for 5 hours at 50° C. Thus, a ketimine compound is prepared. The ketimine compound has an amine value of 418 mgKOH/g.

(Preparation of Oily Liquid)

A reaction vessel is charged with 749 parts of the toner components dispersion, 115 parts of the prepolymer, and 2.9 parts of the ketimine compound. The mixture is agitated for 1 minute at a revolution of 5,000 rpm using T. K. HOMOMIXER (from PRIMIX Corporation). Thus, an oily liquid is prepared.

(Preparation of Aqueous Medium)

A reaction vessel equipped with a stirrer and a thermometer is charged with 683 parts of water, 11 parts of a reactive emulsifier (a sodium salt of sulfate of ethylene oxide adduct of methacrylic acid ELEMINOL RS-30 from Sanyo Chemical Industries, Ltd.), 83 parts of styrene, 83 parts of methacrylic acid, 110 parts of butyl acrylate, and 1 part of ammonium persulfate. The mixture is agitated for 15 minutes at a revolution of 400 rpm. Thus, an emulsion is prepared.

The emulsion is heated to 75° C. and subjected to a reaction for 5 hours. Subsequently, 30 parts of a 1% aqueous solution of ammonium persulfate are further added to the emulsion, and the mixture is aged for 5 hours at 75° C. Thus, a particulate resin dispersion is prepared.

An aqueous medium is prepared by mixing 990 parts of water, 83 parts of the particulate resin dispersion, 37 parts of a 48.5% aqueous solution of dodecyl diphenyl ether sodium disulfonate (ELEMINOL MON-7 from Sanyo Chemical Industries, Ltd.), 135 parts of a 1% aqueous solution of carboxymethylcellulose sodium (CELLOGEN BS-H-3 from Daiichi Kogyo Seiyaku Co., Ltd.), and 90 parts of ethyl acetate.

(Preparation of Toner)

First, 867 parts of the oily liquid is added to 1,200 parts of the aqueous medium. The mixture is agitated for 5 minutes at a revolution of 13,000 rpm using T. K. HOMOMIXER (from PRIMIX Corporation). Thus, an emulsion slurry is prepared.

Next, the emulsion slurry is contained in a reaction vessel equipped with a stirrer and a thermometer and heated to 30° C. for 8 hours so that the solvents are removed, followed by aging for 4 hours at 45° C. Thus, a dispersion slurry is prepared.

Next, 100 parts of the dispersion slurry is filtered under reduced pressures to obtain a wet cake. The wet cake is mixed with 100 parts of ion-exchange water and the mixture is agitated for 10 minutes at a revolution of 12,000 rpm using T. K. HOMOMIXER (from PRIMIX Corporation), followed by filtering. Thus, a wet cake (i) is prepared.

The wet cake (i) is mixed with 10% hydrochloric acid so as to have a pH of 2.8. The mixture is agitated for 10 minutes at a revolution of 12,000 using T. K. HOMOMIXER (from PRIMIX Corporation), followed by filtering. Thus, a wet cake (ii) is prepared.

The wet cake (ii) is mixed with 300 parts of ion-exchange water and the mixture is agitated for 10 minutes at a revolution of 12,000 using T. K. HOMOMIXER (from PRIMIX Corporation), followed by filtering. This operation is repeated twice. Thus, a wet cake (iii) is prepared.

The wet cake (iii) is dried for 48 hours at 45° C. using a circulating air drier, followed by sieving with a screen having openings of 75 μm. Thus, a mother toner is prepared. The mother toner has a volume average particle diameter of 5.7 μm.

Finally, 100 parts of the mother toner is mixed with 1.0 part of a hydrophobized silica and 0.5 part of a hydrophobized titanium oxide using a HENSCHEL MIXER (from Mitsui Mining Co., Ltd.). Thus, a toner 1 was prepared.

Toner Examples 2-6

The procedure for preparing the toner in Example 1 is repeated except for replacing the quinacridone pigment A with pigments described in Table 1. Thus, toners 2 to 6 are prepared.

Comparative Toner Examples 1-5

The procedure for preparing the toner in Example 1 is repeated except for replacing the quinacridone pigment A with pigments described in Table 1. Thus, comparative toners 7 to 11 are prepared.

TABLE 1

| | | Pigment Mixing Ratio (parts) | | | | |
|---|---|---|---|---|---|---|
| | | Quinacridone | | | | Naphthol |
| | Toner No. | Formula (1) | Pigment Red 122 | Pigment Violet 19 | Total | Pigment Red 269 |
| Example 1 | 1 | 5 | 0 | 0 | 5 | 95 |
| Example 2 | 2 | 35 | 0 | 0 | 35 | 65 |
| Example 3 | 3 | 1.25 | 3 | 0.75 | 5 | 95 |
| Example 4 | 4 | 3 | 1 | 1 | 5 | 95 |
| Example 5 | 5 | 8.75 | 10 | 16.25 | 35 | 65 |
| Example 6 | 6 | 21 | 4 | 10 | 35 | 65 |
| Comparative Example 1 | 7 | 0.5 | 0 | 0 | 0.5 | 99.5 |
| Comparative Example 2 | 8 | 55 | 0 | 0 | 55 | 45 |
| Comparative Example 3 | 9 | 0 | 100 | 0 | 100 | 0 |
| Comparative Example 4 | 10 | 0 | 0 | 0 | 0 | 100 |
| Comparative Example 5 | 11 | 0 | 20 | 0 | 20 | 80 |

Evaluations

Each of the toners prepared above is set in a tandem image forming apparatus (IMAGIO NEO 450 from Ricoh Co., Ltd.). FIGURE is a schematic view illustrating an embodiment the tandem image forming apparatus. The image forming apparatus includes a belt-heating fixing device 25.

The belt-heating fixing device 25 includes a belt 254, a fixing roller 251, a pressing roller 252, a heating roller 253, a fixing roller cleaning roller 256, a pressing roller cleaning roller 257, and a temperature sensor 258. The belt 254 includes a substrate having a thickness of 100 μm made of polyimide, an intermediate elastic layer having a thickness of 100 μm made of a silicone rubber, and an outermost offset prevention layer having a thickness of 15 μm made of PFA. The fixing roller 251 is made of a silicone foam. The pressing roller 252 is a metallic cylinder made of SUS having a thickness of 1 mm, and has an offset prevention layer having a thickness of 2 mm made of a PFA tube and a silicone rubber. The heating roller 253 is a metallic cylinder made of aluminum having a thickness of 2 mm. The surface pressure is $1\times10^5$ Pa.

A toner image including a toner in an amount of 0.3 mg/cm$^2$ is formed on an A4-size long grain paper TYPE 6000 <70W> (from Ricoh Co., Ltd.) and fixed at a fixing temperature of 160° C. so that the fixed toner image has a gloss of from 5 to 15 when the measurement angle is 60°.

The fixed toner image is subjected to a measurement of CIE L*, a*, and b* values using a SPECTRODENSITOMETER 938 (from X-Rite) with a standard light source of CIE-D65.

The color difference ($\Delta E^*_{ab}$) based on L*a*b* color system is calculated from the following equation (A) according to JIS Z8730:

$$\Delta E^*_{ab}=[(\Delta L^*)^2+(\Delta a^*)^2+(\Delta b^*)^2]^{1/2} \quad \text{(A)}$$

wherein ΔL*, Δa*, and Δb* represent the differences in the lightness L* and the color coordinates a* and b* between two object colors, respectively.

The standard color in this evaluation is defined as the standard color on art paper defined in a document "Description of ISO/Japan Color Offset Sheet Printing Color Standard Japan Color Color-Reproduction Printing 2001".

Generally, when $\Delta E^*_{ab}$ is 3 or more, the human eye can recognize the color difference.

The color saturation ($C^*_{ab}$) is calculated from the following equation (B) according to JIS Z8729:

$$C^*_{ab}=[(a^*)^2+(b^*)^2]^{1/2} \quad (B)$$

The coloring power of a toner is evaluated by the image density measured with a SPECTRODENSITOMETER 938 (from X-Rite) with a standard light source of CIE-D65.

TABLE 2

| | Toner No. | Color Saturation | Coloring Power | $\Delta E^*_{ab}$ | Comprehensive Evaluation |
|---|---|---|---|---|---|
| Example 1 | 1 | 76.1 | 1.47 | 2.7 | 4 |
| Example 2 | 2 | 78.2 | 1.41 | — | 4 |
| Example 3 | 3 | 75.9 | 1.43 | 1.1 | 4 |
| Example 4 | 4 | 76.3 | 1.45 | 1.8 | 4 |
| Example 5 | 5 | 76.5 | 1.46 | 2.1 | |
| Example 6 | 6 | 77.9 | 1.44 | 2.9 | 4 |
| Comparative Example 1 | 7 | 69.5 | 1.35 | 11.8 | 1 |
| Comparative Example 2 | 8 | 78.3 | 1.28 | 5.1 | 2 |
| Comparative Example 3 | 9 | 69.1 | 1.19 | 8.5 | 1 |
| Comparative Example 4 | 10 | 67.5 | 1.41 | 10.2 | 1 |
| Comparative Example 5 | 11 | 70.1 | 1.25 | 4.7 | 2 |

The measurement results are shown in Table 2. The comprehensive evaluation results are graded into 4 levels as follows.

4: The coloring power is 1.40 or more, the color saturation is 75 or more, and $\Delta E^*_{ab}$ is less than 3.

3: The coloring power is 1.40 or more, the color saturation is 72 or more and less than 75, and $\Delta E^*_{ab}$ is less than 3.

2: The coloring power is less than 1.40, the color saturation is 70 or more and less than 72, and $\Delta E^*_{ab}$ is 3 or more.

1: The coloring power is less than 1.40, the color saturation is less than 70, and $\Delta E^*_{ab}$ is 3 or more.

This document claims priority and contains subject matter related to Japanese Patent Application No. 2008-247294 filed on Sep. 26, 2008, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A magenta toner, produced by a method comprising:

suspending an oily liquid comprising a binder resin and a colorant in an aqueous medium, wherein the colorant comprises a naphthol pigment and a quinacridone pigment, and wherein the quinacridone pigment comprises at least one pigment having the following formula (1):

(1)

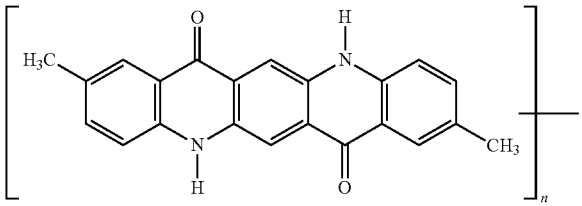

-continued

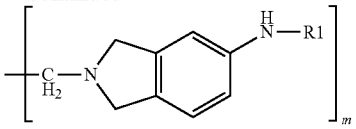

wherein n represents a natural number of from 1 to 3, m represents a natural number of from 1 to 6, and R1 represents a hydrogen atom, an alkyl group, a methoxy group, or a group having the following formula (2):

(2)

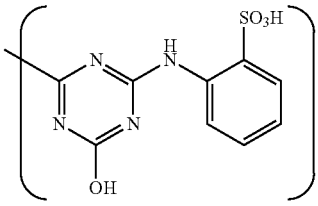

2. The magenta toner according to claim 1, wherein the naphthol pigment comprises C. I. Pigment Red 269.

3. The magenta toner according to claim 2, wherein a weight ratio of the pigment having the formula (1) to the C. I. Pigment Red 269 is from 1/99 to 50/50.

4. The magenta toner according to claim 1, wherein the naphthol pigment comprises C. I. Pigment Red 269 and the quinacridone pigment further comprises C. I. Pigment Red 122.

5. The magenta toner according to claim 1, wherein the naphthol pigment comprises C. I. Pigment Red 269 and the quinacridone pigment further comprises C. I. Pigment Red 122 and C. I. Pigment Violet 19.

6. The magenta toner according to claim 1, wherein a weight ratio of the quinacridone pigment to the naphthol pigment is from 1/99 to 50/50.

7. The magenta toner according to claim 1, wherein the quinacridone pigment comprises the pigment having the formula (1) in an amount of from 1 to 80% by weight based on a total weight of the quinacridone pigment.

8. The magenta toner according to claim 1, wherein the method further comprises:

preparing the oily liquid comprising the binder resin and the colorant, wherein the binder resin comprises a polyester resin and a polyester resin precursor;

dissolving a compound capable of elongating or cross-linking with the polyester resin precursor in the oily liquid; and emulsifying the oily liquid in an aqueous medium to prepare an emulsion, while subjecting the polyester resin precursor to at least one of an elongation reaction or a cross-linking reaction.

9. The magenta toner according to claim 1, wherein a ratio (Dv/Dn) of a volume average particle diameter (Dv) to a number average particle diameter (Dn) of the toner is from 1.00 to 1.30, and wherein the toner includes toner particles having a circularity of 0.950 or less in an amount of from 20 to 80% by number based on a total number of toner particles.

10. The magenta toner according to claim 1, wherein a ratio (Dv/Dn) of a volume average particle diameter (Dv) to a number average particle diameter (Dn) of the toner is 1.20 or less.

11. The magenta toner according to claim 1, wherein the toner includes toner particles having a particle diameter of 2 μm or less in an amount of from 1 to 20% by number based on a total number of toner particles.

12. The magenta toner according to claim 1, wherein the binder resin comprises a polyester resin in an amount of from 50 to 100% by weight based on a total weight of the binder resin.

13. The magenta toner according to claim 12, wherein the polyester resin includes THF-soluble components, and the THF-soluble components have a weight average molecular weight of from 1,000 to 30,000.

14. The magenta toner according to claim 12, wherein the polyester resin has an acid value of from 15.0 to 30.0 mgKOH/g.

15. The magenta toner according to claim 1, wherein the binder resin has a glass transition temperature of from 35 to 65° C.

16. The magenta toner according to claim 8, wherein the polyester resin precursor has a site reactive with a compound having an active hydrogen group, and the polyester resin precursor produces a polymer having a weight average molecular weight of from 3,000 to 20,000.

17. The magenta toner according to claim 1, wherein the toner has a glass transition temperature of from 40 to 70° C.

18. A two-component developer, comprising:

the magenta toner according to claim 1; and a carrier.

* * * * *